US008579140B2

(12) United States Patent
Delagrange et al.

(10) Patent No.: US 8,579,140 B2
(45) Date of Patent: Nov. 12, 2013

(54) CHILD-RESISTANT DISPENSING CLOSURES AND CLOSURE COMPONENTS

(75) Inventors: Donald Paul Delagrange, Toledo, OH (US); Philip D. Bourgeois, Perrysburg, OH (US); Gregory A. Geisinger, Toledo, OH (US); Maurice R. Gnepper, Fremont, OH (US); Darin M. Pugne, Perrysburg, OH (US)

(73) Assignee: Rexam Healthcare Packaging Inc., Perrysburg, OH (US)

( * ) Notice: Subject to any disclaimer, the term of this patent is extended or adjusted under 35 U.S.C. 154(b) by 1227 days.

(21) Appl. No.: 12/335,729

(22) Filed: Dec. 16, 2008

(65) Prior Publication Data

US 2010/0147732 A1 Jun. 17, 2010

(51) Int. Cl.
*B65D 51/04* (2006.01)

(52) U.S. Cl.
USPC ..... 220/254.5; 220/258.2; 220/203.22; 215/221

(58) Field of Classification Search
USPC ..... 220/254.5, 254.7, 254.8, 255, 560.03, 220/258.2, 203.1, 238, 252, 254.9, 257.2, 220/259.3, 259.4, 259.2, 254.3, 259.1, 291; 221/5, 151.152, 154, 156, 63; 206/528, 206/494; 215/221
See application file for complete search history.

(56) References Cited

U.S. PATENT DOCUMENTS

| | | | | |
|---|---|---|---|---|
| 3,951,291 | A * | 4/1976 | Libit | 215/220 |
| 4,057,159 | A | 11/1977 | Fillmore et al. | |
| 4,059,198 | A | 11/1977 | Mumford | |
| 4,207,982 | A | 6/1980 | Maxwell et al. | |
| 4,485,932 | A | 12/1984 | Kusz | |
| 4,934,547 | A * | 6/1990 | Mayes et al. | 215/306 |
| 4,941,580 | A | 7/1990 | Julian | |
| 5,197,616 | A * | 3/1993 | Buono | 215/220 |
| 5,213,223 | A * | 5/1993 | Minnette | 215/216 |
| 5,299,701 | A | 4/1994 | Barker et al. | |
| 5,316,161 | A * | 5/1994 | Gargione | 215/220 |
| 5,348,201 | A * | 9/1994 | Koo | 222/556 |
| 5,370,251 | A * | 12/1994 | Buono | 215/220 |
| 6,095,354 | A * | 8/2000 | Herr et al. | 215/225 |
| 6,923,335 | B2 | 8/2005 | Fujita et al. | |
| 7,132,009 | B2 * | 11/2006 | Chiang | 96/50 |
| 7,165,692 | B2 * | 1/2007 | Konefal et al. | 215/220 |
| 7,185,776 | B1 * | 3/2007 | Konefal | 215/228 |
| 7,510,094 | B1 * | 3/2009 | Willis et al. | 215/218 |
| 7,815,061 | B1 * | 10/2010 | Robinson et al. | 215/220 |
| 7,837,749 | B2 * | 11/2010 | Seeley et al. | 55/283 |
| 7,975,862 | B2 * | 7/2011 | Gnepper | 215/224 |

(Continued)

FOREIGN PATENT DOCUMENTS

| | | |
|---|---|---|
| EP | 0379775 | 8/1990 |
| GB | 2158048 | 11/1985 |
| WO | WO 97/37900 | 10/1997 |
| WO | WO 2008/073151 | 6/2008 |

*Primary Examiner* — Mickey Yu
*Assistant Examiner* — Rafael Ortiz
(74) *Attorney, Agent, or Firm* — Reising, Ethington, PC

(57) ABSTRACT

A child-resistant dispensing closure for a container may include one or the other or both of a dispensing cover non-removably securable to a container, or an outer cover non-removably securable and rotatable with respect to the inner cover and cooperable with the dispensing cover to render the closure child-resistant. According to another embodiment, an outer cover may include a flange to aid users in pushing and turning the outer cover with their fingers.

42 Claims, 17 Drawing Sheets

(56) References Cited

U.S. PATENT DOCUMENTS

| | | | | |
|---|---|---|---|---|
| 7,976,612 | B2 * | 7/2011 | Shiina | 95/28 |
| 2003/0168423 | A1 | 9/2003 | Williams | |
| 2007/0028775 | A1 * | 2/2007 | Loup et al. | 96/83 |
| 2008/0245796 | A1 * | 10/2008 | Gnepper | 220/281 |
| 2008/0276705 | A1 * | 11/2008 | Yeung | 73/426 |
| 2008/0314860 | A1 * | 12/2008 | Pugne et al. | 215/330 |
| 2010/0264144 | A1 * | 10/2010 | Nusbaum et al. | 220/258.2 |
| 2011/0155688 | A1 * | 6/2011 | Johnston et al. | 215/316 |

* cited by examiner

CHILD-RESISTANT DISPENSING CLOSURES AND CLOSURE COMPONENTS

The present disclosure relates to closures and packages for dispensing products, for example, prescription medication, and more particularly to child-resistant dispensing closures and closure components.

BACKGROUND AND SUMMARY OF THE DISCLOSURE

U.S. Pat. Nos. 4,057,159, 4,059,198 and 4,485,932 disclose child-resistant prescription packages that include a container, a closure, and a spring/seal disk disposed between the closure and the container. The closure has a skirt with internal lugs that cooperate with locking notches on external projections around the mouth of the container for securing the closure to the container. An internal abutment on the closure cooperates with the spring/seal disk to urge the closure away from the container so that the lugs are resiliently captured within the notches. When it is desired to remove the closure, the closure and container are pushed relative toward one another so that the lugs clear the notches and the closure may be rotated off of the container. When the closure is assembled to the container, the lugs cam beneath convex surfaces on the container projections against the force of the spring element until the lugs snap into the notches on the projections.

Although the packages disclosed in the above-noted patents have enjoyed substantial commercial acceptance and success, further innovations are desirable. For example, a general object of the present disclosure is to provide a child-resistant package for storing and dispensing products, such as pelletized medication tablets or pills, that may be filled by a pharmacist and that can aid a user in complying with a dosing regimen associated with the products.

The present disclosure embodies a number of aspects that can be implemented separately from or in combination with each other.

A child-resistant dispensing package in accordance with one aspect of the disclosure includes a container having an open end and an inner cover non-removably secured to the container. The inner cover has a deck with a dispensing opening, a peripheral skirt secured the container in a non-removable manner, a lid hinged to the deck for pivotal movement between a closed position closing the dispensing opening and an open position spaced from the dispensing opening, and an external shoulder with an annular array of under-notches. The package also includes an outer cover with a base wall and a peripheral skirt with internal lugs for receipt over the shoulder within the under-notches of the inner cover, and at least one internal spring for engaging the inner cover and biasing the outer cover away from the inner cover and releasably registering the internal lugs of the outer cover within the under-notches on the inner cover. The outer cover also includes a central opening surrounding the lid and defined by lobes and scallops, and cam surfaces on the lobes. Downward pressure on the outer cover against the at least one internal spring releases the outer cover for rotation with respect to the inner cover and one or more of the cam surfaces engages the lid and cams the lid from the closed position toward the open position so that the lid can be manually further moved to the open position and medication can be dispensed through the dispensing opening.

In accordance with another aspect of the disclosure, there is provided a child-resistant dispensing closure securable to a container that includes an inner cover securable to the container. The inner cover includes a base having a deck with a dispensing opening, a lid coupled to the base for movement between a closed position closing the dispensing opening and an open position spaced from the dispensing opening, a skirt depending from the deck, a shoulder with an annular array of under-notches. The closure also includes an outer cover rotatably coupled to the inner cover and including a peripheral skirt with internal lugs for receipt over the shoulder of the inner cover and within the under-notches of the shoulder. The outer cover also includes a base wall from which the peripheral skirt depends and which includes a central opening at least partially surrounding the lid and at least partially defined by lobes having cam surfaces to cooperate with the lid.

In accordance with a further aspect of the disclosure, there is provided an outer cover of a child-resistant dispensing closure securable and rotatable with respect to an inner cover of the closure having a flip-top lid. The outer cover includes a peripheral skirt with internal lugs for receipt over the inner cover and within under-notches of the inner cover. The outer cover also includes a base wall from which the peripheral skirt depends and including a central opening.

In accordance with an additional aspect of the disclosure, there is provided a cover of a child-resistant dispensing closure securable to a container having locking projections disposed about an open end thereof. The cover includes lugs and stops cooperable with the locking projections of the container to render the cover non-removable from the container.

In accordance with yet another aspect of the present disclosure, there is provided a push-and-turn cover for a container, including a base wall, a peripheral skirt depending from the base wall, and a flange extending from and larger in outer diameter than the peripheral skirt to aid users in pushing and turning the cover with their fingers.

In accordance with still another aspect of the present disclosure, there is provided a child-resistant dispensing package which includes a container having an open end, and a closure non-removably secured to the container. The closure includes a dispensing cover non-removably secured to the open end of the container, and an outer cover non-removably secured to the inner cover and cooperable with the dispensing cover to render the closure child-resistant.

BRIEF DESCRIPTION OF THE DRAWINGS

The disclosure, together with additional objects, features, advantages and aspects thereof, will be best understood from the following description, the appended claims and the accompanying drawings, in which:

DETAILED DESCRIPTION OF PREFERRED EMBODIMENTS

Figure 1:
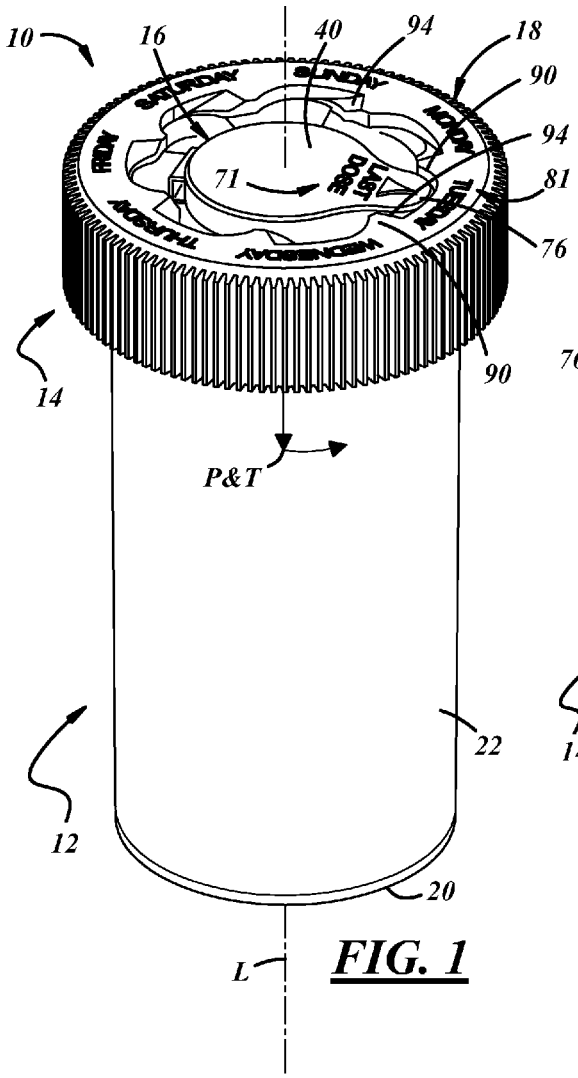
FIG. 1 is a perspective view of a package in accordance with an exemplary embodiment of the present disclosure, illustrating a flip-top lid in a closed, child-resistant position.
Figure 2:
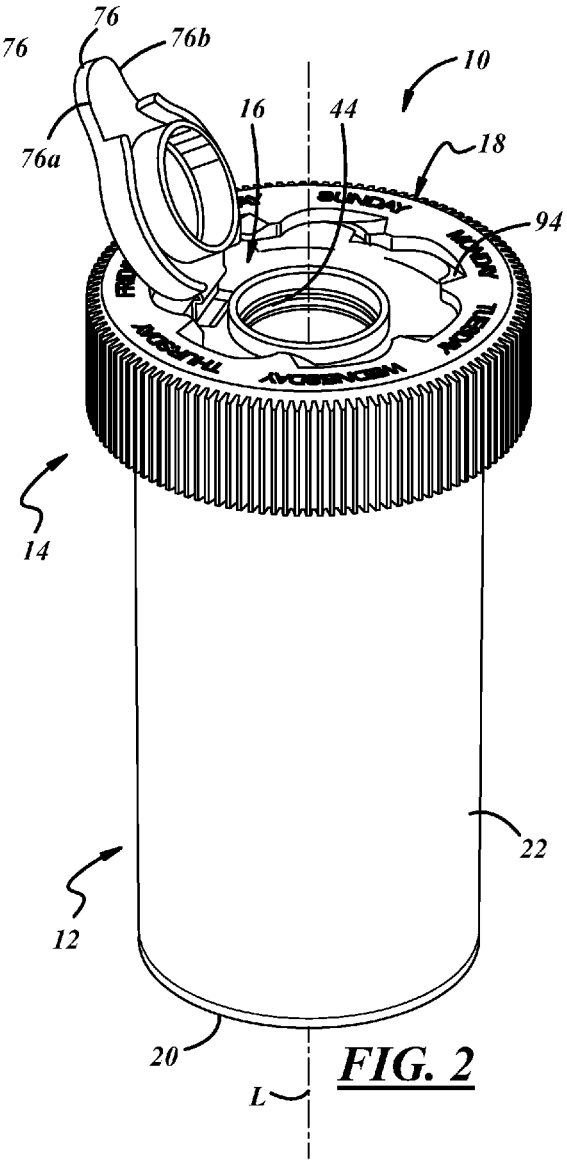
FIG. 2 is a perspective view of the package of FIG. 1, illustrating the flip-top lid in an opened position.
Figure 3:
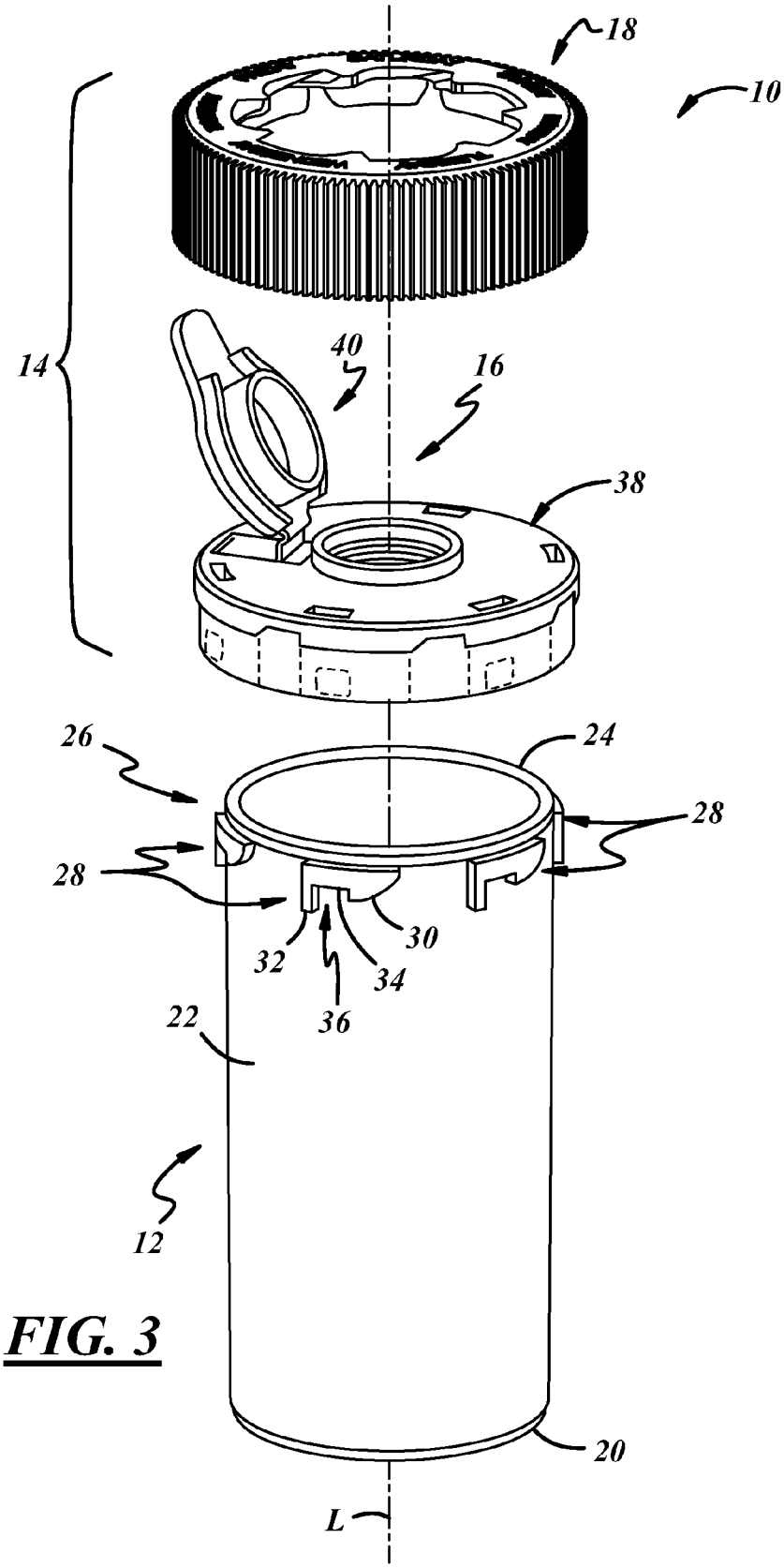
FIG. 3 is an exploded perspective view of the package shown in FIG. 2.

FIGS. 1 through 3 illustrate a child-resistant dispensing package 10 in accordance with one presently preferred embodiment. The package 10 includes a container 12, and a dispensing closure 14 securable to the container 12 in a non-removable configuration and operable in a child-resistant manner. The closure 14 is a multiple component device that includes a dispensing or inner cover 16 for non-removable securement to the container 12, and an outer cover 18 for non-removable but rotatable securement to the inner cover 16. The outer cover 18 may be unidirectionally rotatable and/or indexable with respect to the inner cover 16.

As used herein, the term "cover" includes any suitable type of cap, top, or other closure component for a container. Also, as used herein, the term "non-removable" does not mean unremovable in an absolute sense and, instead, means tending to resist removal. For example, a cover may be unremovable without permanent damage to the cover. In another example, the cover may be unremovable by a child's hands, or perhaps even by an adult's hands, so that, for instance, a tool may be needed to pry the cover off of its container or another cover.

The container 12 is a conventional prescription vial for holding loose content such as pills, and is available from the assignee hereof. As just an example, the container 12 may include a SCREW-LOC brand vial, for instance, T-13, L-13A, or like vials. In an exemplary form, the container 12 includes a bottom wall 20 that is substantially perpendicular to a longitudinal axis L of the package 10, and a container sidewall 22 extending upwardly from the bottom wall 20. Referring now to FIG. 3, the sidewall 22 terminates in a mouth or open end 24 and includes a finish portion 26 adjacent the open end 24. The finish portion 26 may include a circumferential or annular array of locking elements that may be locking projections 28 extending radially outwardly near the open end 24 of the sidewall 22 substantially distal from the bottom wall 20. (As used herein, directional words such as top, bottom, upper, lower, radial, circumferential, lateral, longitudinal, vertical, horizontal, and the like are employed by way of description and not limitation.) Instead of the projections 28, the locking elements may be indentations in the surface of the container 12, or may be any type of recessed surface manifestations adapted to non-removably retain the inner cover 16 to the container 12.

In the illustrated exemplary embodiment, however, the projections 28 may be push-and-turn bayonet lugs, or any other suitable type of external surface manifestations. The projections 28 include underside cam portions 30, stop lug portions 32, and flat undersides 34, all of which cooperate to define notches 36 of the projections 28. The projections 28 generally lie in a plane perpendicular to the longitudinal axis L of the package 10 and are equidistantly spaced about the circumference of the sidewall 22. As shown, there are a total of six projections 28, but more or fewer may be used as desired.

The inner cover 16 is a dispensing cover that is coupled to the container 12 in any suitable manner. For example, the inner cover 16 may be locked to the container 12 via the projections 28 of the container 12. In other embodiments, the inner cover 16 may be adhered, bonded, welded, fastened, threaded, or coupled thereto in any desired non-removable manner. In the illustrated exemplary embodiment, a portion of the inner cover 16 may be sealed within the open end 24 of the container 12 and another portion may be engaged to the projections 28 of the container 12. The inner cover 16 includes a base 38 and a lid 40 pivotably coupled to the base 38. The lid 40 may be a flip-top type of lid to allow dispensing of product out of the container 12.

Figure 4:
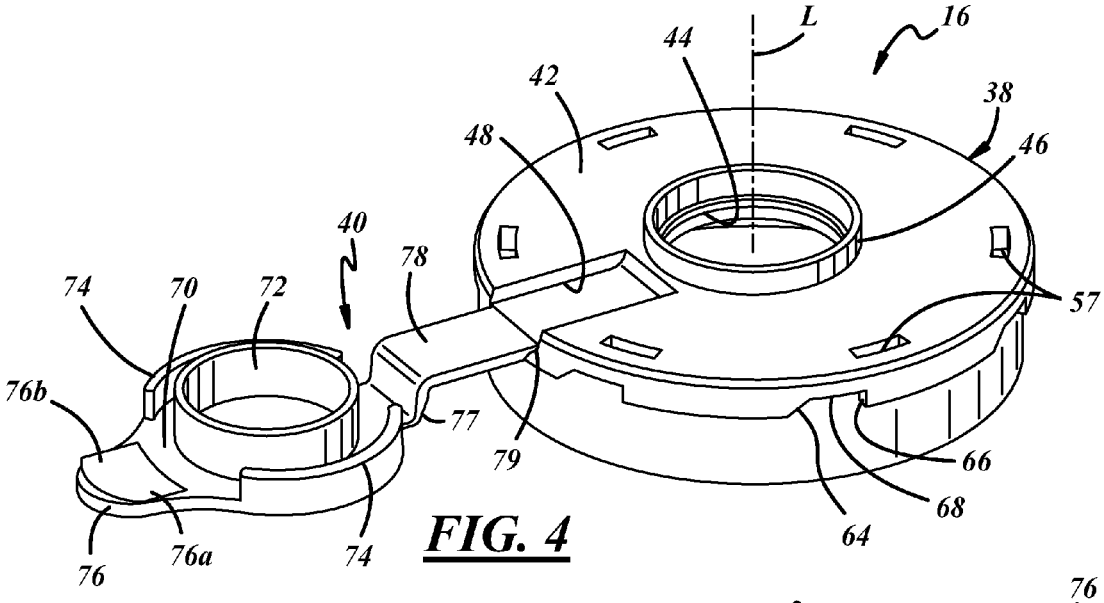
FIG. 4 is a perspective view of an inner cover of a closure of the package of FIG. 1, illustrating a flip-top lid in an opened and extended position, as molded.

As shown in FIG. 4, the base 38 includes a wall or deck 42 lying in a plane transverse to the longitudinal axis L and having a dispensing opening 44 that is defined by an annular wall 46 and a recess 48 to accommodate a portion of the lid 40. As used herein, the term transverse includes being disposed at any angle with respect to the axis L and, for example, may include a perpendicular orientation.

Figure 5:
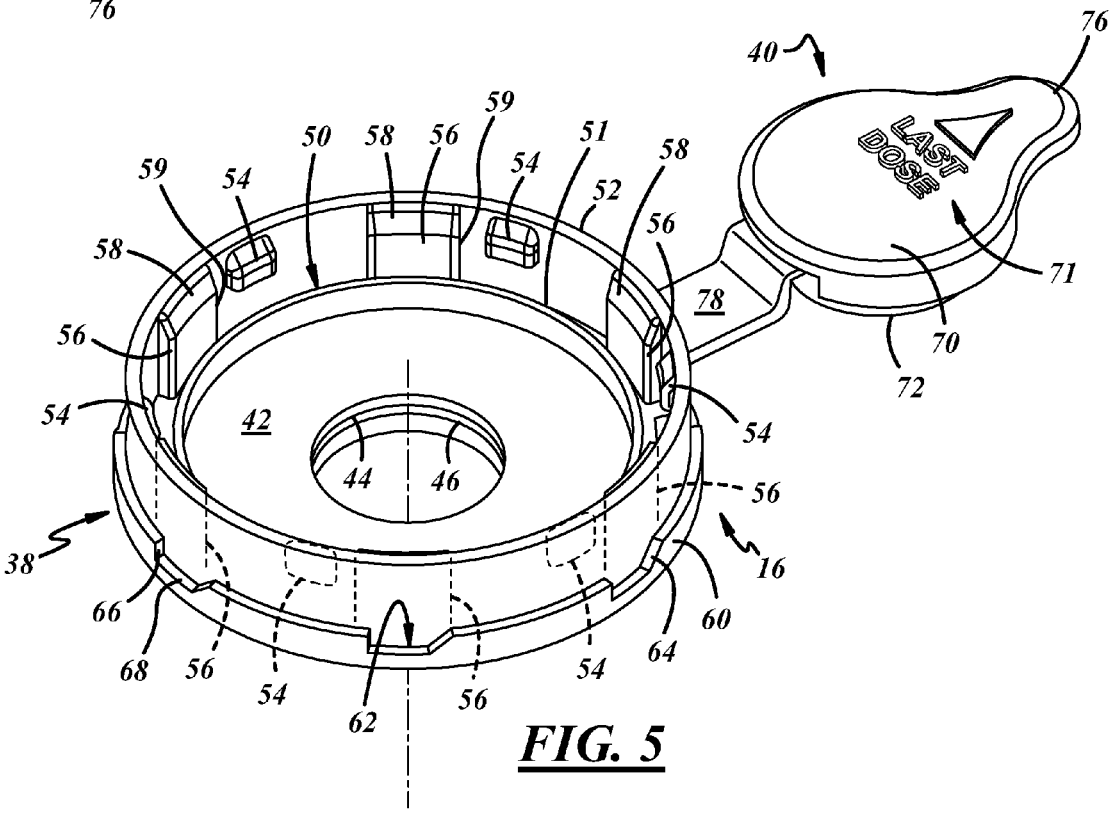
FIG. 5 is a perspective view of the inner cover of FIG. 4 shown in an inverted orientation.

As shown in FIG. 5, the base 38 also includes an inner seal skirt 50 axially extending from an inner surface of the deck 42 and for sealing within the open end 24 of the container 12 (FIG. 3). The seal skirt has an external surface 51 for internal engagement with the open end of the container (FIG. 3) as the inner cover 16 is applied to the container 12. Thus, in the assembled condition of FIGS. 1 and 2, the surface 51 of the skirt 50 is in plug-sealing engagement with the open end of the container 12.

Again, as shown in FIG. 5, the base 38 further includes a peripheral or outer engagement skirt 52 disposed radially outwardly of the inner seal skirt 50 for engagement with the finish 26 of the container 12 (FIG. 3). The outer engagement skirt 52 secures the inner cover 16 to the container 12 in a non-removable manner. For example, the skirt 52 may include a circumferential or annular array of locking elements that may be circumferentially spaced internal lugs 54. The lugs 54 are internal in the sense that they extend radially inwardly from an inner surface of the skirt 52. The lugs 54 cooperate with the external projections 28 on the container 12 to secure the inner cover 16 thereto. Instead of the lugs 54, the locking elements may be indentations in the surface of the skirt 52, or may be any type of recessed surface manifestations adapted to non-removably retain the inner cover 16 to the container 12. The lugs 54 may be either solid, as shown, or hollow, and may be equidistantly spaced, and may be six in number in the illustrated embodiment although any number of lugs 54 may be used, such as the same quantity of container projections 28. The inner cover 16 may include tooling apertures 57 used during molding of the cover 16 to produce the lugs 54.

The outer engagement skirt 52 also includes a plurality of internal stops 56 that cooperate with corresponding portions of the container 12. For example, the internal stops 56 may be lugs or bosses as shown or may be shoulders or any other types of features to cooperate with the projections 28 of the container 12. The stops 56 may have tapered surfaces 58 that assist with assembling the inner cover 16 to the container 12. The stops 56 also include sidewalls 59 that cooperate with the stop lug portions 32 of the projections 28 of the container 12 to render the inner cover 16 effectively non-removable with respect to the container 12 as will be described in more detail below.

The base 38 also includes an external shoulder 60 disposed between the deck 42 and the skirt 52 with an annular array of under-notches 62 defined by cam features 64, stop portions 66, and flat undersides 68 therebetween. Any suitable quantity of under-notches 62 are provided, for example, seven as shown. The shoulder 60 is circumferentially continuous so as to connect the under-notches 62, in contrast to the discrete, separated projections 28 on the container 12 that define the under-notches 36 thereof.

As shown in FIGS. 4 and 5, the lid 40 is hinged to the base 38, for example, at the deck 42, for pivotal movement between a closed position closing the dispensing opening 44 and an open position spaced from the dispensing opening 44. The lid 40 includes a base wall 70 lying in a plane perpendicular to the longitudinal axis L when closed. The lid 40 also includes an annular wall or pintle 72 extending axially from the base wall 70 for sealing engagement with the dispensing opening 44 of the base 38. The lid 40 further includes a skirt 74 (FIG. 4) disposed radially outwardly of the pintle 72 and extending axially from the base wall 70 to aid in resistance to opening of the lid 40. For example, the skirt 74 tends to inhibit a finger from being placed between the lid 40 and the outer cover 18 to render it difficult or even impossible for a user's finger to get leverage on the lid 40 in an attempt to pry open the lid 40. The lid 40 additionally includes a finger tab 76 extending from the base wall 70 to aid in gripping the lid 40. The finger tab 76 includes a cam undersurface, having a thin side **76*a* and a thick side 76*b*, to cooperate with corresponding portions of the outer cover 18 as will be described below. At an opposite side of the lid 40, the lid 40 includes a hinge strap 78 that is integrally coupled to the base wall 70 of the lid 40 at one side and to the base 38 at another side. The strap 78 is engaged to the base deck 42 in any suitable manner, for example, by adhering, welding, fastening, or the like. In a more particular example, the strap 78 may be engaged with the recess 48 (FIG. 4) of the base 38, for example, by interference fit, use of snap beads (not shown) therebetween, or in any other suitable snap-fit manner. The lid 40 additionally includes an indicating feature for assisting a user in complying with a dosage or dosing regimen, such as indicia 71 (FIG. 5) on the base wall 70**.

Referring generally to FIGS. 3 through 5, to apply the inner cover 16 to the container 12, the inner skirt 50 is sealingly received in the open end 24 of the container 12 and the outer skirt 52 is forced over the open end 24 of the container 12. More specifically, inner cover 16 is forced over the container 12 so that the lugs 54 snap over the projections 28 and into the notches 36 of the projections 28, and so that the stops 56 fit between the projections 28 adjacent the stop lug portions 32 of the projections 28. The downward movement of the inner cover 16 with respect to the container 12 resiliently flexes one or both of the inner seal skirt 50 of the cover 16 and/or the sidewall 22 of the container 12 and the cam surfaces of the lugs and stops 54, 56 assist in this regard.

Once in this applied position, the cover 16 is effectively non-removable with respect to the container 12, wherein the cover 16 is not intended for removal by a user under normal operation. The stops 56 act as locks wherein the sidewalls 59 of the stops 56 contact the stop lug portions 32 when it is attempted to rotate the cover 16 off of the container 12, even when the cover 16 is pushed against the container 12 to clear the lugs 54 out of the under-notches 36. Among other things, this helps prevent the inner cover 16 from being inadvertently removed when a user pushes and turns the outer cover 18 to index the cover 18 relative to the inner cover 16.

Figure 6:
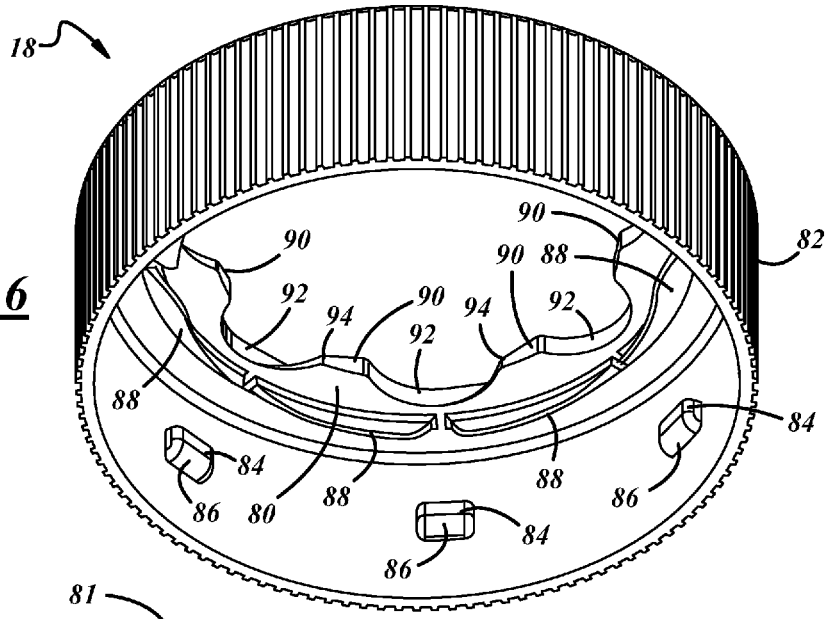
FIG. 6 is a bottom perspective view of an outer cover of the closure of the package of FIG. 1, illustrating spring elements and lugs.

As shown in FIG. 6, the outer cover 18 includes a base wall 80 and a peripheral skirt 82 depending axially from the base wall 80. The outer cover 18 cooperates with the inner cover 16 to render the closure 14 child-resistant and to render the flip-top lid openable by push-and-turn indexing of the outer cover 18. The peripheral skirt 82 includes internal lugs 84 extending radially inwardly from an inner surface of the skirt 82 and having cam surfaces 86. With reference also to FIG. 4, the lugs 84 are provided for snap receipt over the shoulder 60 of the inner cover 16 and within the under-notches 62 of the shoulder 60 to render the outer cover 18 effectively non-removable from the inner cover 16. The cam features 64 are disposed on the skirt 52 to cooperate with the internal lugs 84 to urge the lugs 84 into the under-notches 62. In other words, the cam features 64 assist with registration of the lugs 84, and provide tactile feedback to a user that the outer cover 18 is being rotated in the design-intended direction about the inner cover 16. Any quantity of the lugs 84 may be used, for example, seven as shown to correspond to a weekday dosing regimen. The base wall 80 includes a biasing device such as one or more internal springs 88 for engaging a portion of the inner cover 16, for example, the deck 42, to bias the outer cover 18 in a direction axially away from the inner cover 16 and, thus, releasably lock the internal lugs 84 of the outer cover 18 within the under-notches 62 of the inner cover 16. The springs 88 extend in a radially inward direction as shown, or may extend radially outwardly. In another embodiment, springs also or instead may be provided on the inner cover 16 for cooperation with corresponding portions of the outer cover 18.

Figure 7:
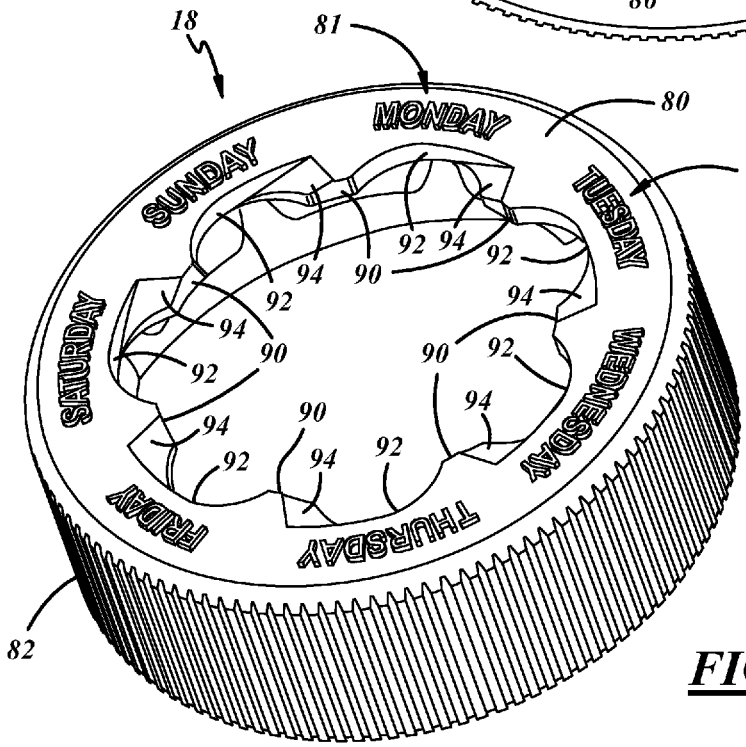
FIG. 7 is a top perspective view of the outer cover of FIG. 6, illustrating flip-top cam features and dosing indicia.

As shown in FIG. 7, the base wall 80 includes a central opening that is adapted to at least partially surround the lid 40 and that is at least partially defined by lobes 90, and may also be defined by scallops 92. In other words, the central opening may be defined by a minor diameter of the lobes 90, and by the scallops 92. The lobes 90 and the scallops 92 may be of any suitable shape, size, and quantity. The base wall 80 further includes dosing indicia 81 corresponding to or aligned with the scallops 92. The base wall 80 includes cam surfaces 94 that cooperate with the finger tab 76 of the lid 40 of the cover 16 (FIG. 4). The cam surfaces 94 may be provided on the lobes 90.

Referring to FIG. 1, when the lid 40 is closed, the finger tab 76 is disposed between adjacent portions of the base 80 and cannot readily be grasped for lifting. But the outer cover 18 is pushed or depressed and turned or rotated with respect to the inner cover 16 as indicated by arrows P&T. Referring to FIGS. 1 and 2, downward pressure on the outer cover 18 against the force offered by the springs 88 (FIG. 6) releases the outer cover 18 so that the outer cover 18 is rotated with respect to the inner cover 16. Accordingly, the cam surfaces 94 of the outer cover 18 engage the finger tab 76 of the lid 40 and cam the lid 40 from the closed position (FIG. 1) toward the open position (FIG. 2). Continued rotation of the outer cover 18 indexes or again brings the cover internal lugs 84 (FIG. 6) into alignment with the cover under-notches 62 (FIG. 4), at which point the cover springs 88 (FIG. 6) push the outer cover 18 outwardly into locked engagement with the inner cover 16. In the meantime, with the lid 40 partially lifted by the cam, the lid 40 can be manually further moved to the open position and medication or other product can be dispensed through the dispensing opening 44. In one embodiment, when the lid 40 is reclosed, pointing indicia 71 on the lid 40 will point to the indicia 81 on the cover 18.

The dosing indicia 71, 81 indicates to a user when a last or most recent dose of medication was taken, or may provide any other suitable indication to a user. The indicia 71, 81 are molded onto the respective elements, printed on the respective elements, and/or provided on labels adhered to the respective elements, for example. In the various embodiments disclosed in the present application, the dosing indicia 81 comprises days of the week according to a seven day dosing regimen, but other indicia can be employed, for example, AM/PM or twice-daily indicia, Morning/Afternoon/Evening or thrice-daily indicia, or the like.

In general, the components of the package 10 are manufactured according to techniques known to those skilled in the art, including injection molding. Similarly, the package 10 is assembled according to known techniques including manual or automated methods. Likewise, any suitable materials can be used in making the components, such as polymeric materials. Such materials can be selected based on their compatibility with the product to be contained and dispensed, flexibility, and/or suitability for use as a hand-held package. Particular exemplary materials may include polypropylene for the container and closure materials, and/or low or high density polyethylenes for the closure material(s).

FIGS. 8-23 illustrate another exemplary embodiment of a package. This embodiment is similar in many respects to the embodiment of FIGS. 1-7 and like numerals between the embodiments generally designate like or corresponding elements throughout the several views of the drawing figures. Additionally, the descriptions of the embodiments are incorporated by reference into one another and the common subject matter generally may not be repeated here.

Figure 8:
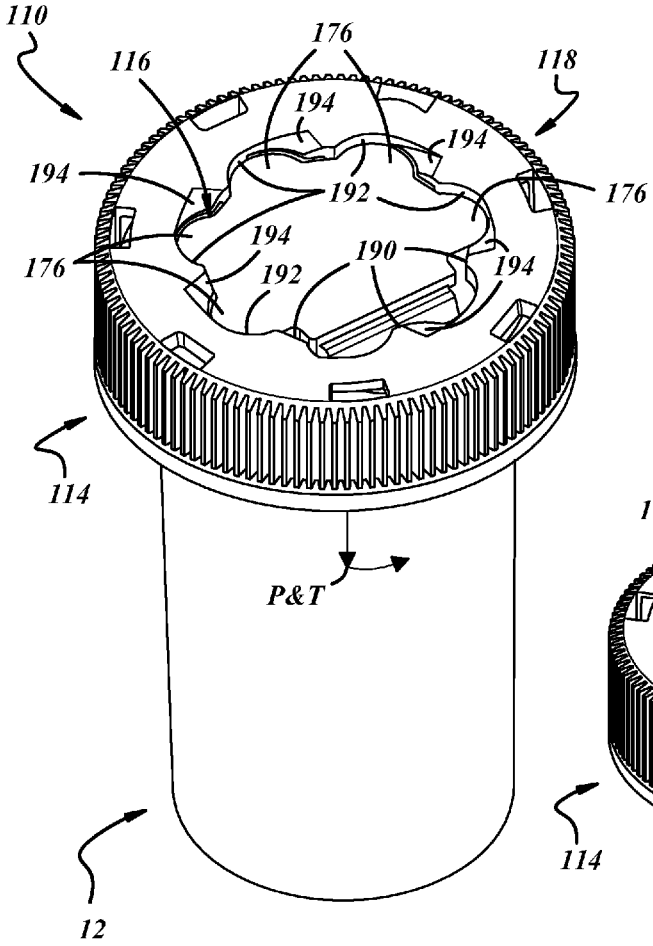
FIG. 8 is a perspective view of a package in accordance with another exemplary embodiment of the present disclosure, illustrating a lobed flip-top lid in a closed, child-resistant position.
Figure 9:
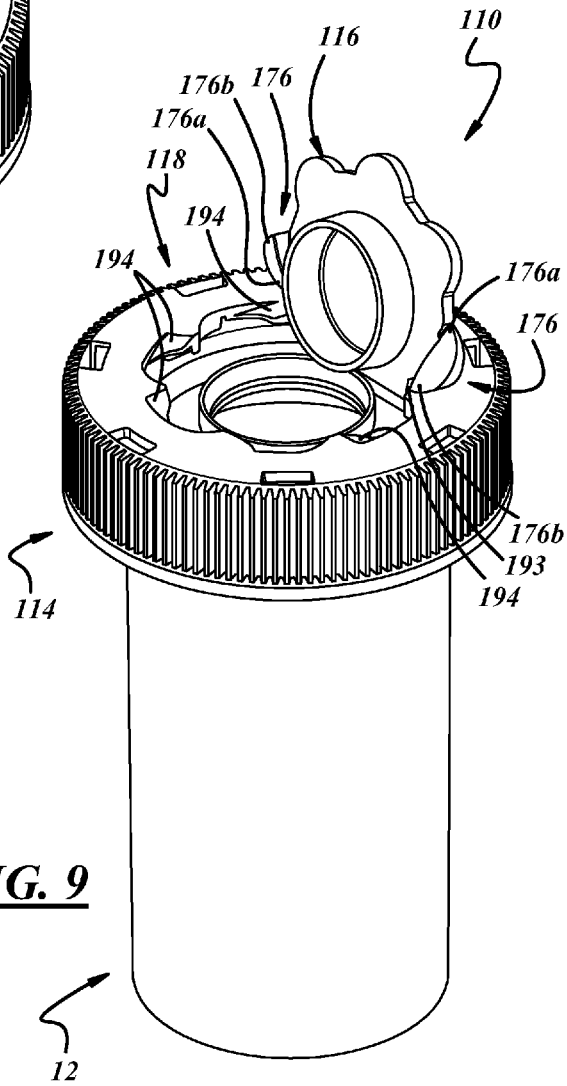
FIG. 9 is a perspective view of the package of FIG. 8, illustrating the lobed flip-top lid in an opened position.
Figure 10:
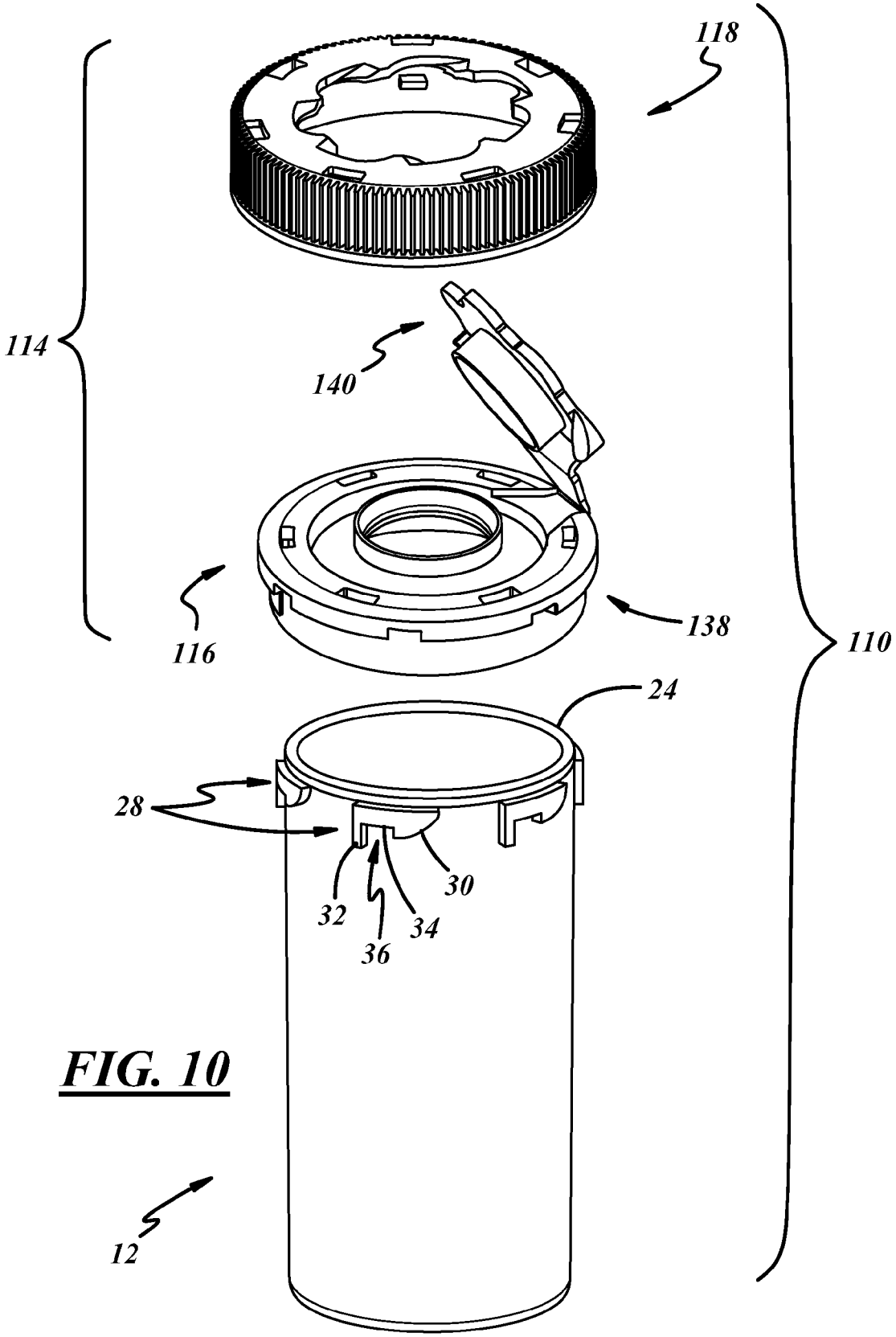
FIG. 10 is an exploded perspective view of the package shown in FIG. 9.

FIGS. 8 through 10 illustrate a package 110 in accordance with another presently preferred embodiment. The package 110 includes the container 12 and a dosing-indicating rotatable closure 114 that is securable to the container 12 in a child-resistant mode of operation. The closure 114 includes an inner cover 116 for securement to the container 12, and an outer cover 118 for securement to the inner cover 116. The inner cover 116 is coupled to the container 12, wherein a portion of the inner cover 116 is sealed within the open end 24 of the container 12 and another portion is engaged to the projections 28 of the container 12. The inner cover 116 includes a base 138 and a lid 140 pivotably coupled to the base 138, wherein the lid 140 may be a flip-top lid.

Figure 11:
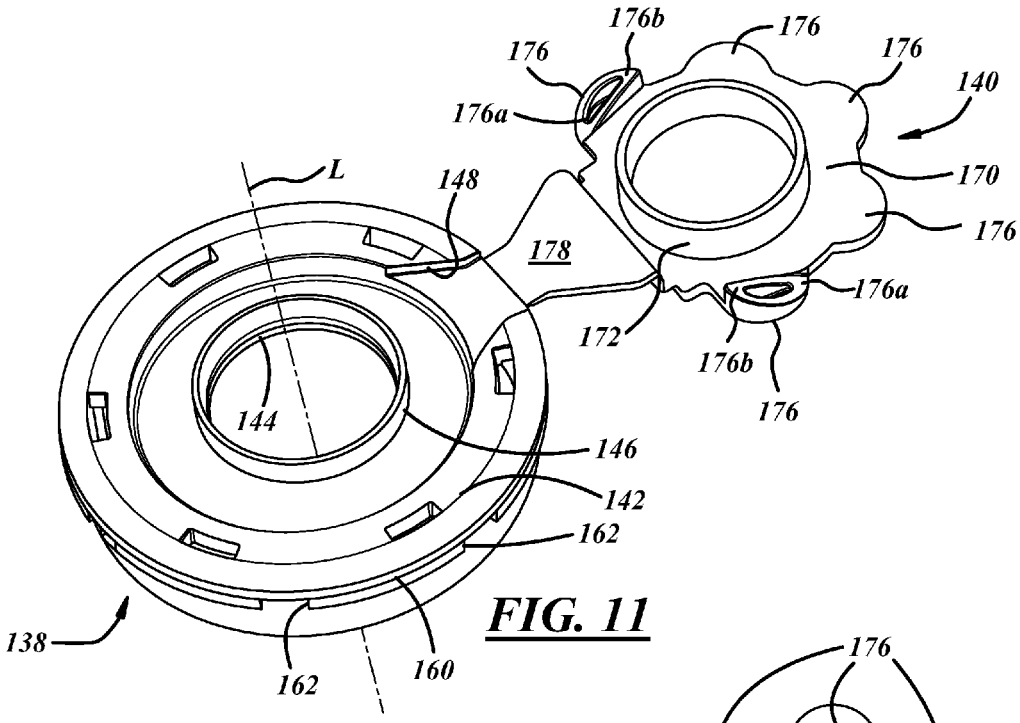
FIG. 11 is a perspective view of an inner cover of a closure of the package of FIG. 8, illustrating the lobed flip-top lid in an opened and extended position, as molded.

Referring to FIG. 11, the base 138 includes a wall or deck 142 lying in a plane transverse to the longitudinal axis L and having a dispensing opening 144 that is defined by an annular wall 146 and a recess 148 to accommodate a portion of the lid 140.

Figure 12:
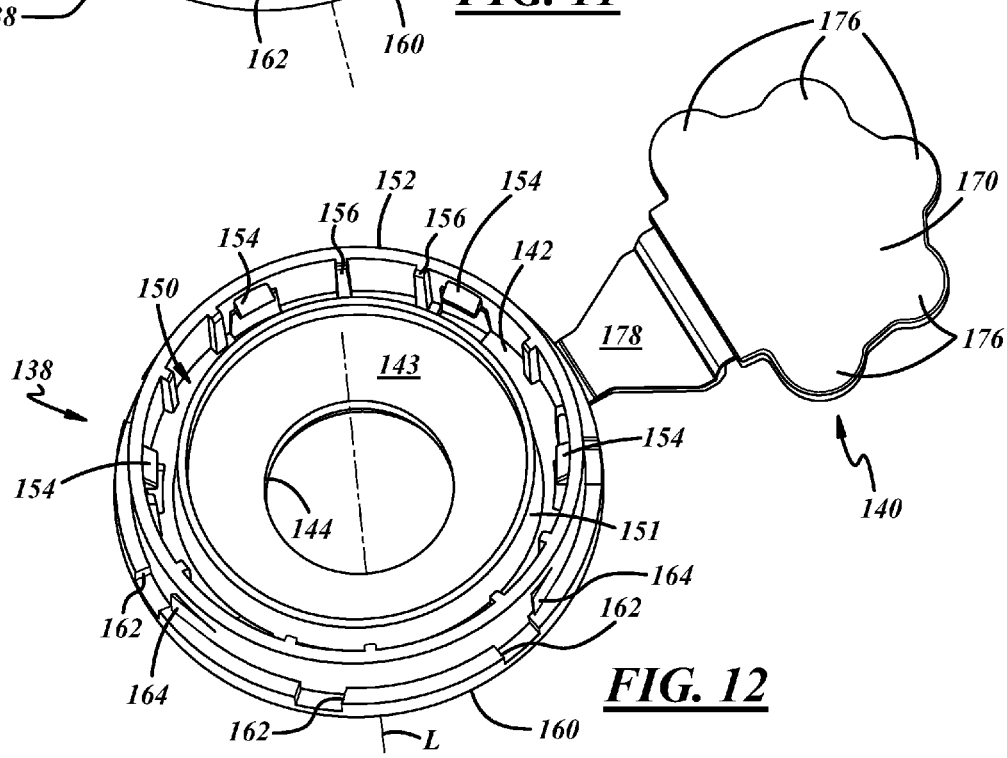
FIG. 12 is a perspective view of the inner cover of FIG. 11 shown in an inverted orientation.

Referring to FIG. 12, the base 138 also includes an inner seal skirt 150 axially extending from an inner surface of the deck 142 and for sealing within the open end 24 of the container 12 (FIG. 10). The seal skirt 150 has an external surface 151 for engagement with the open end 24 of the container 12 (FIG. 10) as the inner cover 116 is applied to the container 12. Thus, in the assembled condition of FIGS. 8 and 9, the surface 151 of the skirt 150 is in plug-sealing engagement with the open end 24 of the container 12. In FIG. 12, the base 138 includes a funnel 143 radially inboard of the skirt 150 to facilitate dispensing of product through the dispensing opening 144. For example, the funnel 143 may be dome-shaped or hemispherically shaped, angled, curved, or the like.

Referring to FIGS. 10 and 12, the base 138 further includes a peripheral or outer engagement skirt 152 disposed radially outwardly of the inner seal skirt 150 for engagement with the finish 26 of the container 12 (FIG. 10). The outer engagement skirt 152 includes a circumferential or annular array of locking elements that may be circumferentially spaced internal lugs 154 extending radially inwardly from an inner surface of the skirt 152 and for cooperating with the external projections 28 on the container 12 (FIG. 10) to secure the inner cover 116 to the container 12 in a non-removable manner. The inner seal skirt 150 also flexes the end portion of the container wall 22 radially outwardly to provide spring force that holds the lugs 154 within the notches 36 of the projections 28, and/or the container wall 22 could flex the seal skirt 150 radially inwardly to provide such spring force. The outer engagement skirt 152 also includes a plurality of internal stops 156 that cooperate with corresponding portions of the container 12, for example, to cooperate with the stop lug portions 32 of the projections 28 of the container 12 to render the inner cover 116 effectively non-removable from the container 12. The base 138 also includes an external shoulder 160 disposed between the deck 142 and the skirt 152 with an annular array of under-notches 162.

Figures 18, 20, 24:
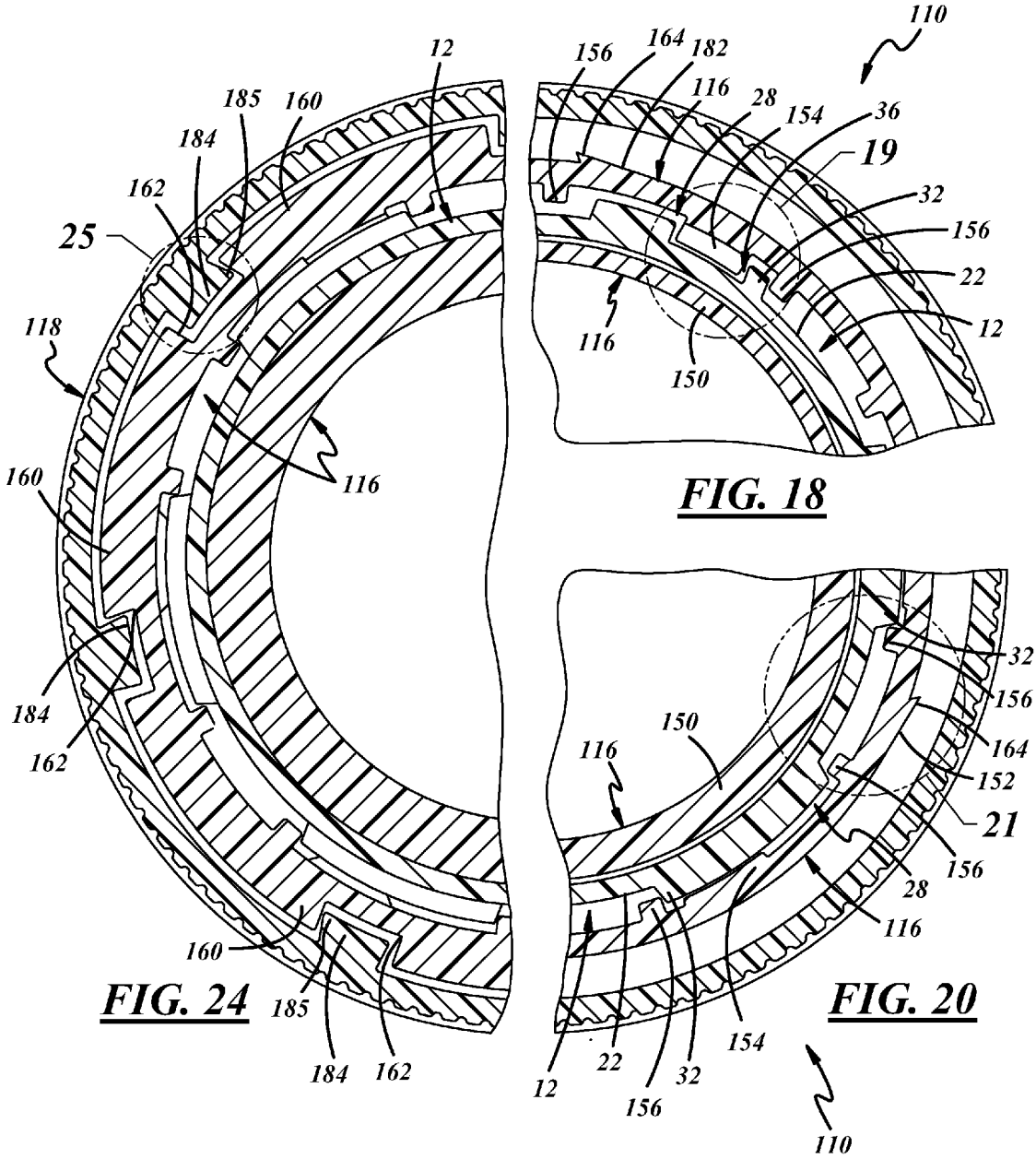
FIG. 18 is a fragmentary sectional view of the package of FIG. 8, taken along line 18-18 of FIG. 16.
FIG. 20 is a fragmentary sectional view of the package of FIG. 8, taken along line 20-20 of FIG. 16.
FIG. 24 is a fragmentary sectional view of the package of FIG. 8, taken along line 24-24 of FIG. 16.
Figure 19:
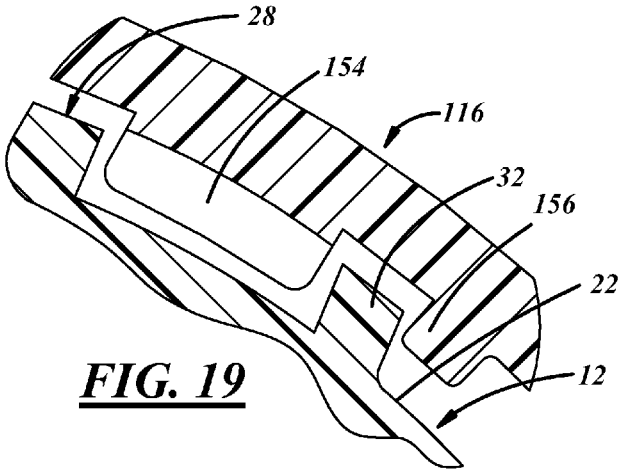
FIG. 19 is an enlarged fragmentary view of a portion of the package of FIG. 8, taken from circle 19 of FIG. 18.
Figure 21:
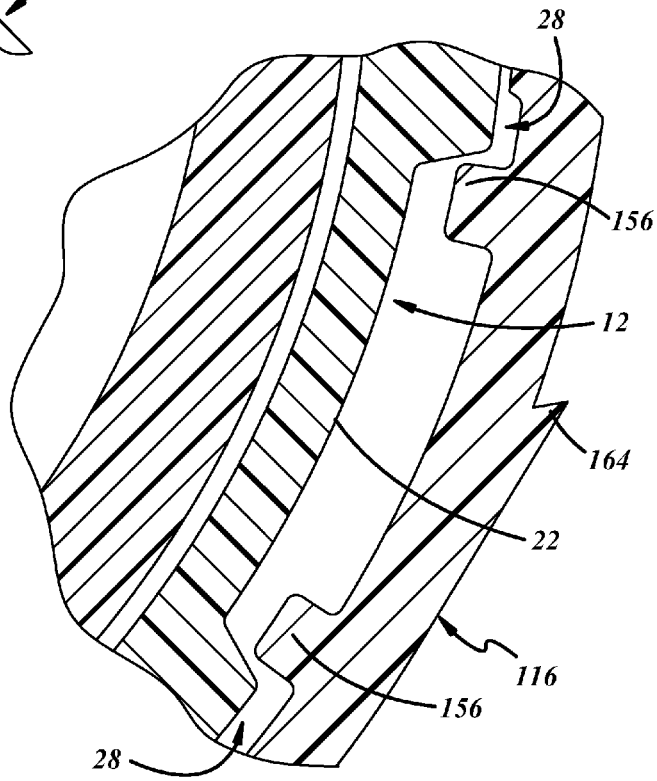
FIG. 21 is an enlarged fragmentary view of a portion of the package of FIG. 8, taken from circle 21 of FIG. 20.
Figure 25:
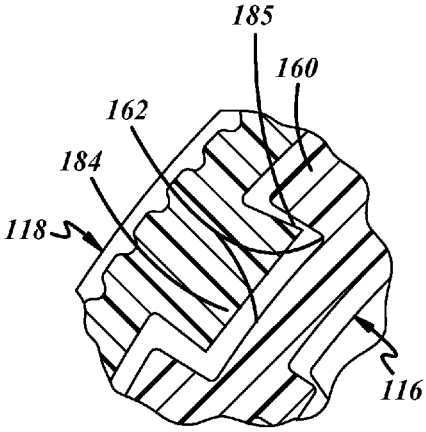
FIG. 25 is an enlarged fragmentary view of a portion of the package of FIG. 8, taken from circle 25 of FIG. 24.
Figure 22:
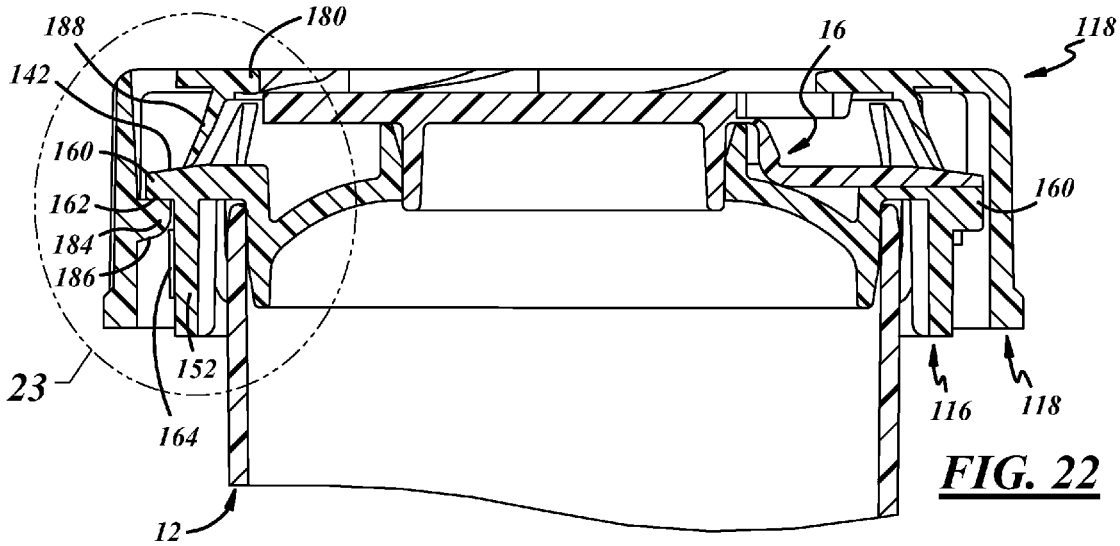
FIG. 22 is a cross-sectional view of the package of FIG. 8, taken along line 22-22 of FIG. 15.

Referring to FIGS. 18, 20, and 22, the inner cover 116 includes one or more cam features 164 disposed on the skirt 152 adjacent the under-notches 162 to permit the outer cover 118 to be unidirectionally rotated with respect to the inner cover 116. More specifically, when the outer cover 118 is applied to the inner cover 116 and rotated in one direction with respect thereto, the outer cover skirt 182 will flex to allow the outer cover lugs 184 to ride over the cam features 164. Once the lugs 184 have been displaced just past the trailing edges or cam stop portions 185 of the cam features 164, the lugs 184 will snap into detent into the under-notches 162. In other words, the cam features 164 assist with registration of the lugs 184 into the under-notches 162, and provide tactile feedback to a user that the outer cover 118 is being rotated in the design-intended direction about the inner cover 116. But if the outer cover 118 is attempted to be rotated in the opposite direction, then cam stop portions 185 of the lugs 184 will interfere with corresponding portions of the cam features 164 to prevent such attempted rotation.

Referring to FIGS. 11 and 12, the lid 140 is hinged to the base 138, for example, at the deck 142, for pivotal movement between a closed position closing the dispensing opening 144 and an open position spaced from the dispensing opening 144. The lid 140 includes a base wall 170 lying in a plane perpendicular to the longitudinal axis L when closed. The lid 140 also includes an annular wall or pintle 172 extending axially from the base wall 170 for sealing engagement with the dispensing opening 144 of the base 138. The lid 140 additionally includes several lobes 176 extending from the base wall 170. At an opposite side of the lid 140, the lid 140 includes a hinge strap 178 that is integrally coupled to the base wall 170 of the lid 140 at one side and to the base 138 at another side. The strap 178 is snap-fit into engagement with the recess 148 (FIG. 11) of the base 138, for example, by interference fit, use of snap beads (not shown) therebetween, or in any other suitable snap-fit manner. The strap 178 may be relatively wider adjacent the base 170 of the lid to deter tampering. Opposed lobes 176 adjacent to either side of the strap 178 includes cam undersurfaces, which has thin sides 176*a* and thick sides 176*b*, to cooperate with corresponding portions of the outer cover 118 (FIG. 10) as will be described below. The lid 140 additionally includes a dosing compliance feature (not shown), for example, dosing indicia, in any suitable location.

Figure 16:
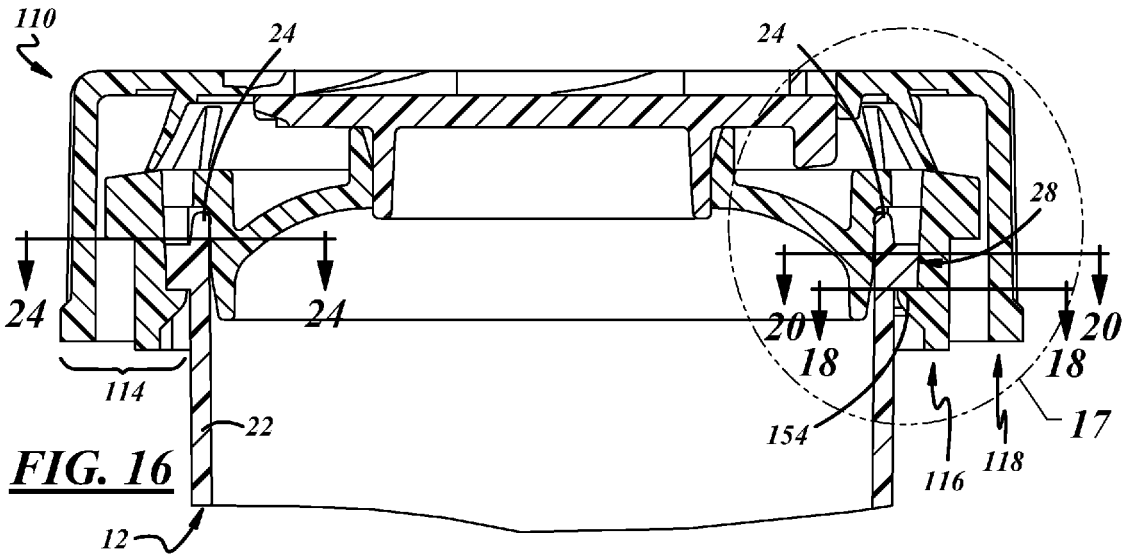
FIG. 16 is a cross-sectional view of the package of FIG. 8, taken along line 16-16 of FIG. 15.
Figure 17:
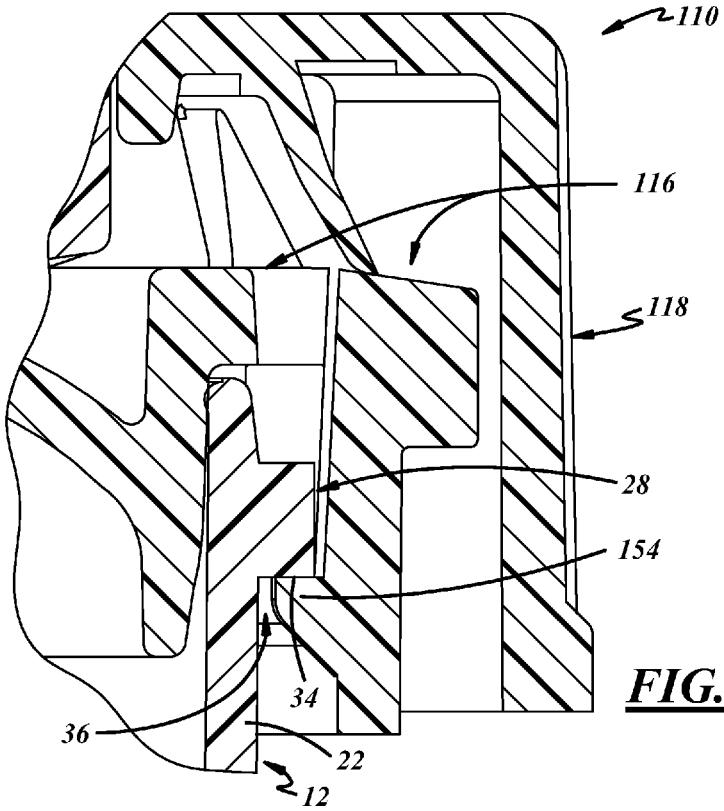
FIG. 17 is an enlarged fragmentary view of the package of FIG. 8, taken from circle 17 of FIG. 16.

Referring to FIGS. 16 through 18, to apply the inner cover 116 to the container 12, the inner skirt 150 is sealingly received in the open end 24 of the container 12 and the outer skirt 152 is received over the open end 24 of the container 12. The outer skirt 152 is forced over the open end 24 of the container 12. More specifically, inner cover 116 is forced over the container 12 so that the lugs 154 snap over the projections 28 and into the notches 36 of the projections 28, and so that the stops 156 fit between the projections 28 adjacent the stop lug portions 32 of the projections 28. The downward movement of the inner cover 116 with respect to the container 12 resiliently flexes one or both of the inner seal skirt 150 of the cover 116 and/or the sidewall 22 of the container 12 and the cam surfaces of the lugs and stops 154, 156 assist in this regard.

Once in this applied position, the cover 116 is effectively non-removable, wherein the cover 116 is not intended to be removed by a user under normal operation. The stops 156 act as locks wherein the stops 156 contact the stop lug portions 32 (FIG. 20) when it is attempted to rotate the cover 116 off of the container 12, even when the cover 116 is pushed against the container 12 to clear the lugs 154 out of the under-notches 36.

Figure 13:
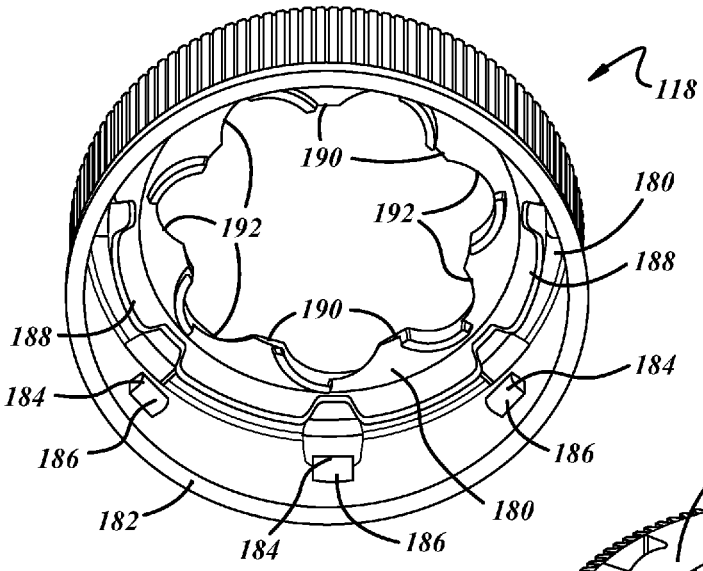
FIG. 13 is a bottom perspective view of an outer cover of the closure of the package of FIG. 8, illustrating spring elements and lugs.
Figure 23:
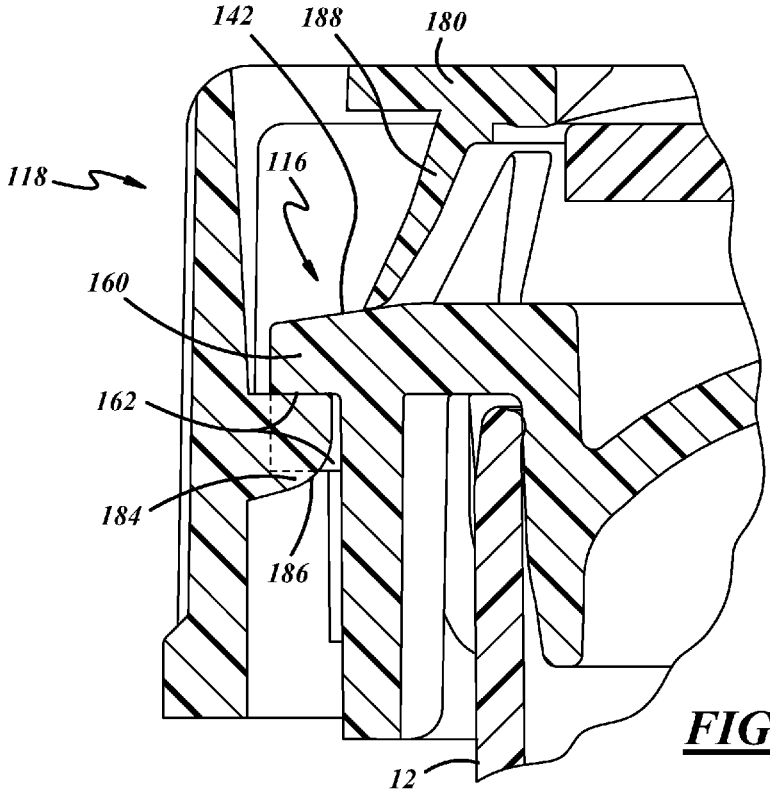
FIG. 23 is an enlarged fragmentary view of a portion of the package of FIG. 8, taken from circle 23 of FIG. 22.
Figure 26:
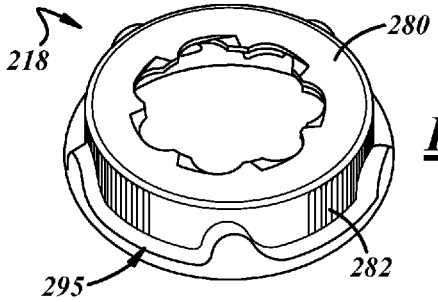
FIG. 26 is a perspective view of a cover in accordance with another exemplary embodiment of the present disclosure, illustrating a first exemplary version of a flange to aid consumers in pushing down and turning the cover.
Figure 29:
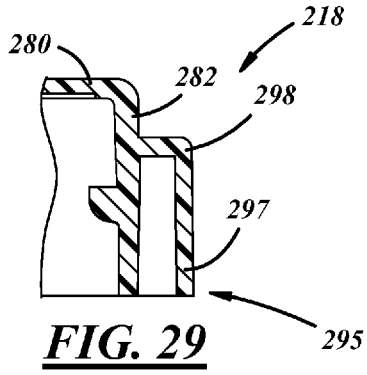
FIG. 29 is a fragmentary sectional view of the cover of FIG. 26, taken along line 29-29 of FIG. 27.
Figure 27:
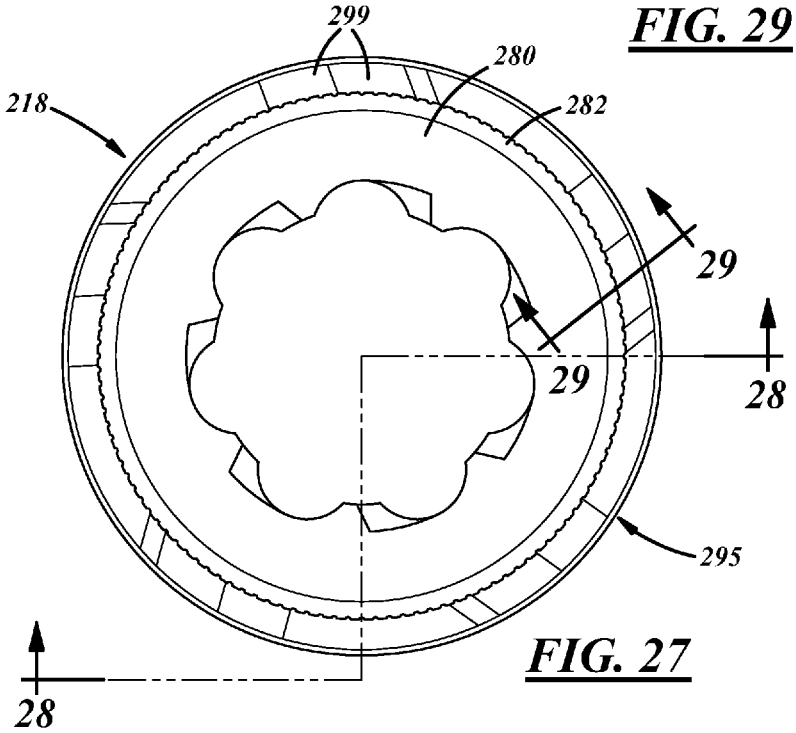
FIG. 27 is a top view of the cover of FIG. 26.
Figure 28:
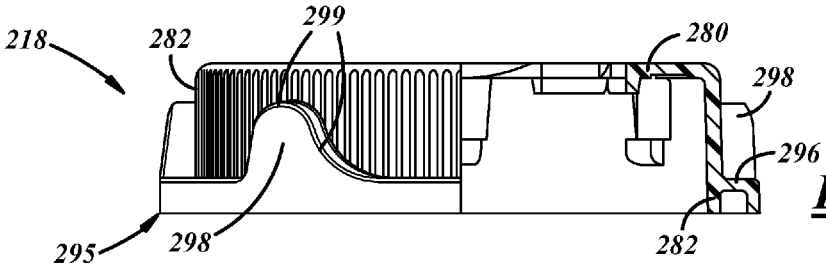
FIG. 28 is a quarter-sectional view of the cover of FIG. 26, taken along line 28-28 of FIG. 27.
Figure 30:
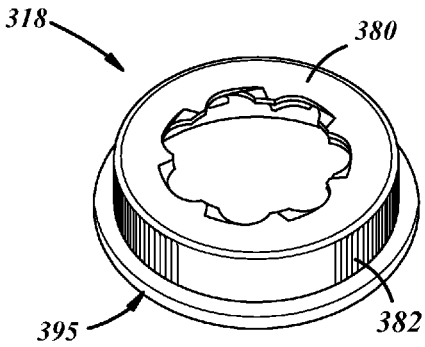
FIG. 30 is a perspective view of a cover in accordance with another exemplary embodiment of the present disclosure, illustrating a second exemplary version of a flange to aid consumers in pushing down and turning the cover.
Figure 33:
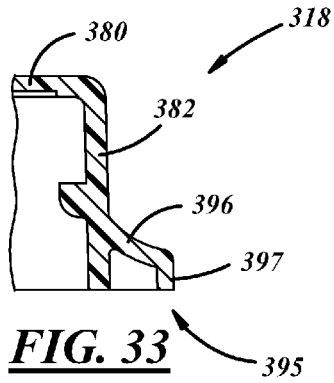
FIG. 33 is a fragmentary sectional view of the cover of FIG. 30, taken along line 33-33 of FIG. 31.
Figure 31:
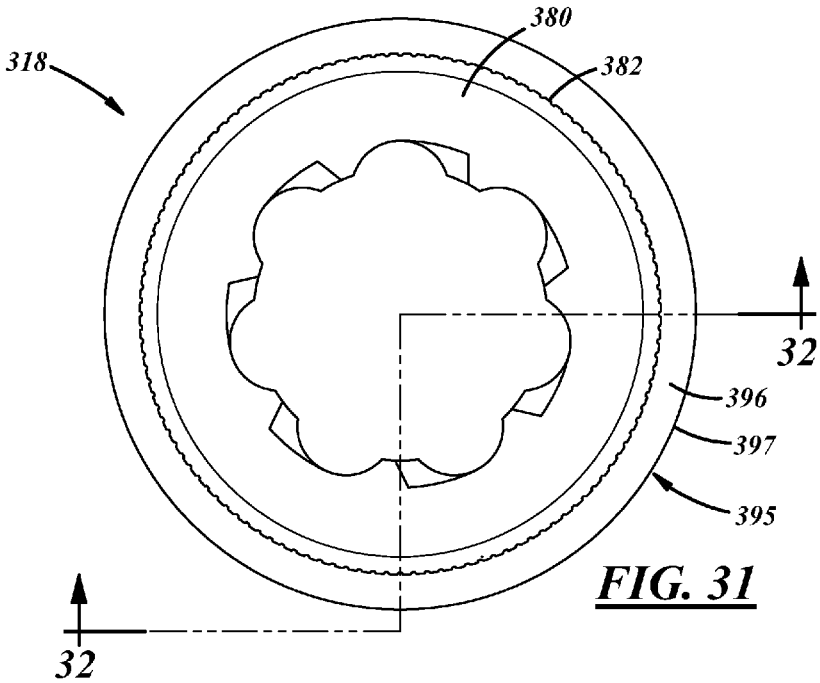
FIG. 31 is a top view of the cover of FIG. 30.
Figure 32:
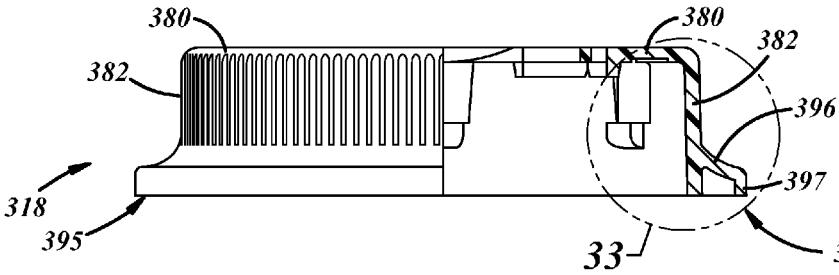
FIG. 32 is a quarter-sectional view of the cover of FIG. 30, taken along line 32-32 of FIG. 31.
Figure 34:
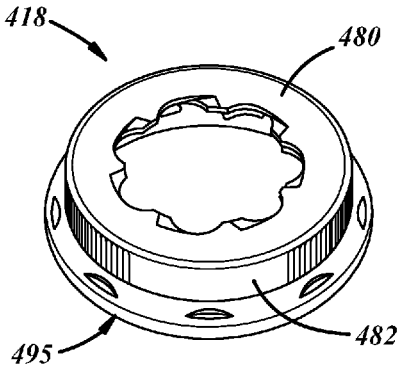
FIG. 34 is a perspective view of a cover in accordance with another exemplary embodiment of the present disclosure, illustrating a third exemplary version of a flange to aid consumers in pushing down and turning the cover.
Figure 37:
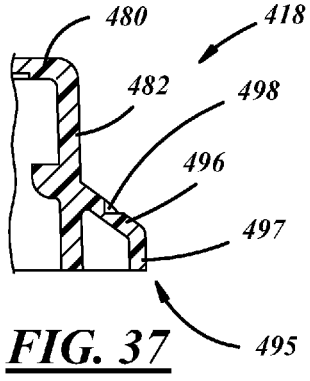
FIG. 37 is a fragmentary sectional view of the cover of FIG. 34, taken along line 37-37 of FIG. 34.
Figure 35:
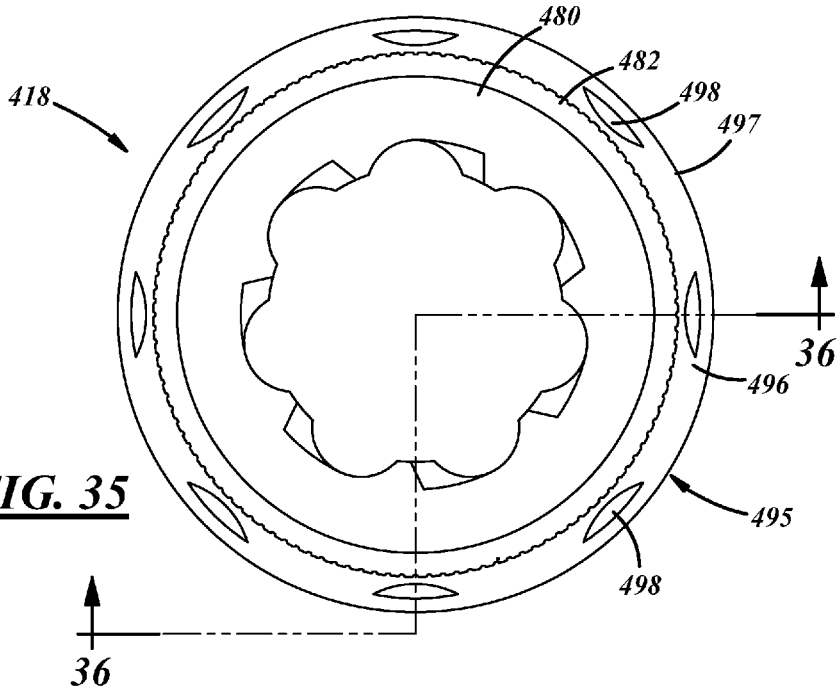
FIG. 35 is a top view of the cover of FIG. 34.
Figure 36:
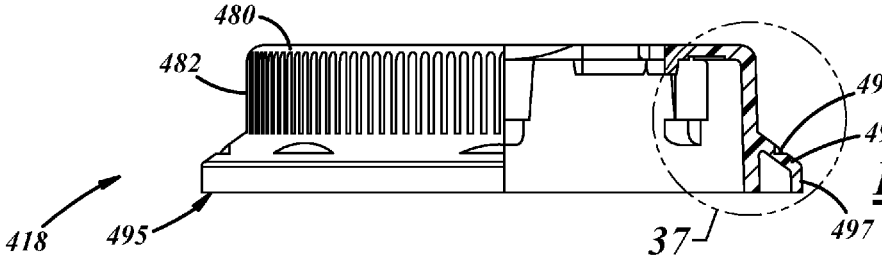
FIG. 36 is a quarter-sectional view of the cover of FIG. 34, taken along line 36-36 of FIG. 35.
Figure 38:
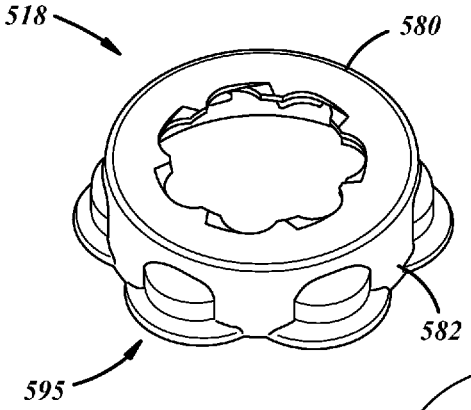
FIG. 38 is a perspective view of a cover in accordance with another exemplary embodiment of the present disclosure, illustrating a fourth exemplary version of a flange to aid consumers in pushing down and turning the cover.

Referring to FIG. 13, the outer cover 118 includes a base wall 180 and a peripheral skirt 182 depending axially from the base wall 180. The peripheral skirt 182 includes internal lugs 184 extending radially inwardly from an inner surface of the skirt 182 and having cam surfaces 186. With reference also to FIGS. 22 and 23, the lugs 184 are provided for snap receipt over the shoulder 160 of the inner cover 116 and within the under-notches 162 of the shoulder 160 to render the outer cover 118 effectively non-removable from the inner cover 116. The base wall 180 includes a biasing device such as one or more internal springs 188 for engaging a portion of the inner cover 116, for example, the deck 142, to bias the outer cover 118 in a direction axially away from the inner cover 116 and, thus, releasably lock the internal lugs 184 of the outer cover 118 within the under-notches 162 of the inner cover 116. The springs 188 extend in a radially outward direction, as shown, or may extend radially inwardly.

Figure 14:
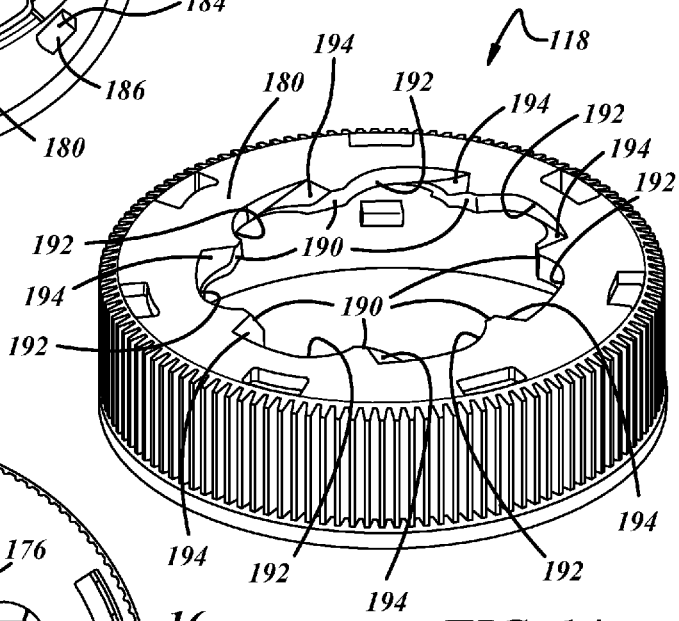
FIG. 14 is a top perspective view of the outer cover of FIG. 13, illustrating flip-top cam features and dosing indicia.
Figure 15:
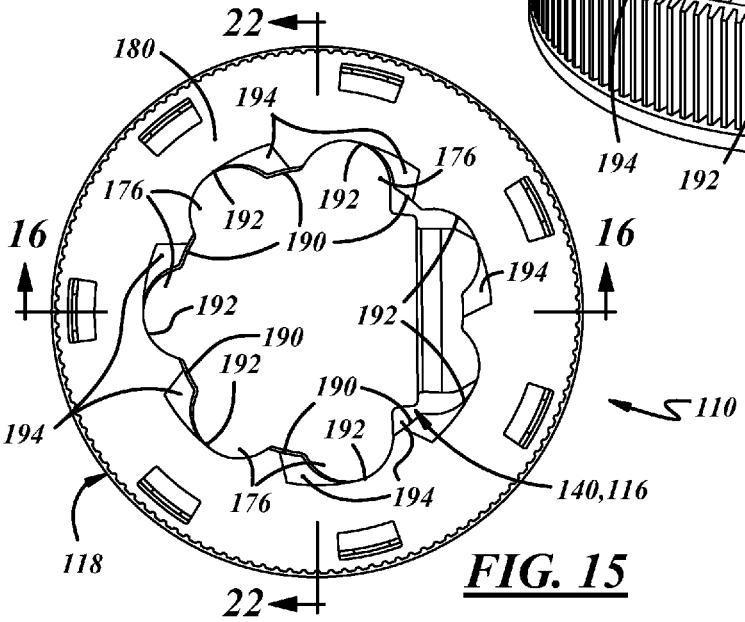
FIG. 15 is a top view of the package of FIG. 8.

Referring to FIGS. 14 and 15, the base wall 180 includes a central opening that is adapted to at least partially surround the lid 140 (FIG. 15) and that is at least partially defined by lobes 190, and may also be defined by scallops 192 that correspond to the lobes 176 of the inner cover 116. The base wall 180 includes cam surfaces 194 of the lobes 190 that cooperate with the lobes 176 of the lid 140 of the inner cover 116 (FIG. 15). Referring to FIG. 15, when the lid 140 is closed, the lobes 176 are disposed so closely to corresponding scallops 192 and to portions of the base 180 between the scallops 192, such that the lid 140 cannot readily be grasped for lifting. In other words, the lid lobes 176 closely correspond to the outer cover scallops 192 to inhibit a finger from being placed therebetween, thereby rendering it difficult or even impossible for a user's finger to get leverage on the lid 140 in an attempt to pry open the lid 140.

But, referring to FIG. 8, the outer cover 118 is pushed or depressed and turned or rotated with respect to the inner cover 116 as indicated by arrows P&T. Referring generally to FIGS. 8 and 9, downward pressure on the outer cover 118 against the force offered by the springs 188 (FIG. 13) releases the outer cover 118 so that the outer cover 118 is rotated with respect to the inner cover 116. Accordingly, the cam surfaces 194 of the outer cover 118 engage the opposed lobes 176 of the lid 140 having cam undersurfaces defined between portions 176*a*, 176*b*, so as to cam the lid 140 from the closed position (FIG. 8) toward the open position (FIG. 9). The lobe cam portions 176*a*, 176*b* may be of substantially the same height, and may be sized and arranged as shown to allow the lid 140 to lift to about 35-45 degrees (preferably 40 degrees) of initial opening.

Continued rotation of the outer cover 118 indexes or again brings the outer cover internal lugs 184 (FIG. 13) into alignment with the inner cover under-notches 162 (FIG. 11), at which point the cover springs 188 (FIG. 13) push the outer cover 118 outwardly into locked engagement with the inner cover 116. As shown in FIG. 9, as the outer cover 118 moves to its position of locked engagement with the inner cover 116, a portion 193 of the cover 118 adjacent the lobe cam portion 176*b* will engage the lobe cam portion 176*b* to further open the lid 140 from its initially opened position. For example, the lid 140 may be opened another five to twenty degrees. With the lid 140 further lifted, the lid 140 can be manually further moved to a further open position and medication or other product can be dispensed through the dispensing opening 144.

FIGS. 26 through 42 illustrate several additional exemplary embodiments of a cover for a container, wherein the cover may be a push-and-turn child-resistant type of closure. These embodiments are similar in many respects to the embodiments of FIGS. 1 through 23 and like numerals between the embodiments generally designate like or corresponding elements throughout the several views of the drawing figures. Additionally, the descriptions of the embodiments are incorporated by reference into one another and the common subject matter generally may not be repeated here.

FIGS. 26 through 29 illustrate a cover 218 in accordance with another presently preferred embodiment. The cover 218 includes a base wall 280 and a peripheral skirt 282 depending axially from the base wall 280. The cover 218 may be an outer cover for use with the inner covers 16, 116 described above, or may be any other suitably type of closure. The cover 218 also includes a flange 295 extending from the skirt 282 to aid users in pushing down and turning the cover 218 with their fingers. The flange 295 includes a generally transversely extending wall 296 that extends from the skirt 282, and a generally axially extending rim 297 that extends from the wall 296. The flange 295 also includes a plurality of lugs 298 that may have curved surfaces 299. The user's fingers may engage the top of the wall 296, which provides a good axial reaction feature, as well as the wavy or curved surfaces 299 of the lugs 298, which provide a good circumferential reaction feature to aid the user in positively gripping and turning the cover 218.

FIGS. 30 through 33 illustrate a cover 318 in accordance with another presently preferred embodiment. The cover 318 includes a base wall 380 and a peripheral skirt 382 depending axially from the base wall 380, and a flange 395 extending from the skirt 382 to aid users in pushing down and turning the cover 318 with their fingers. The flange 395 includes a generally transversely extending wall 396 that extends from the skirt 382, and a generally axially extending rim 397 that extends from the wall 396. The wall 396 has an incurvate surface to provide a comfortable reaction surface for a user's fingers to aid the user in gripping and turning the cover 318.

FIGS. 34 through 37 illustrate a cover 418 in accordance with another presently preferred embodiment. The cover 418 includes a base wall 480 and a peripheral skirt 482 depending axially from the base wall 480, and a flange 495 extending from the skirt 482 to aid users in pushing down and turning the cover 418 with their fingers. The flange 495 includes a generally transversely extending wall 496 that extends from the skirt 482, and a generally axially extending rim 497 that extends from the wall 496. The wall 496 may be generally flat and disposed at an angle with respect to the skirt 482 as shown. Also, the flange 495 includes a plurality of scallops 498. The user's fingers may engage the top of the wall 496, and the scallops 498 may provide good frictional features to aid the user in positively gripping and turning the cover 418.

Figure 41:
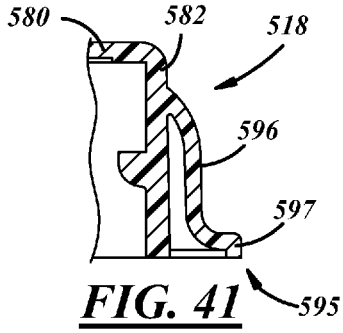
FIG. 41 is a fragmentary sectional view of the cover of FIG. 38, taken along line 41-41 of FIG. 39.
Figure 39:
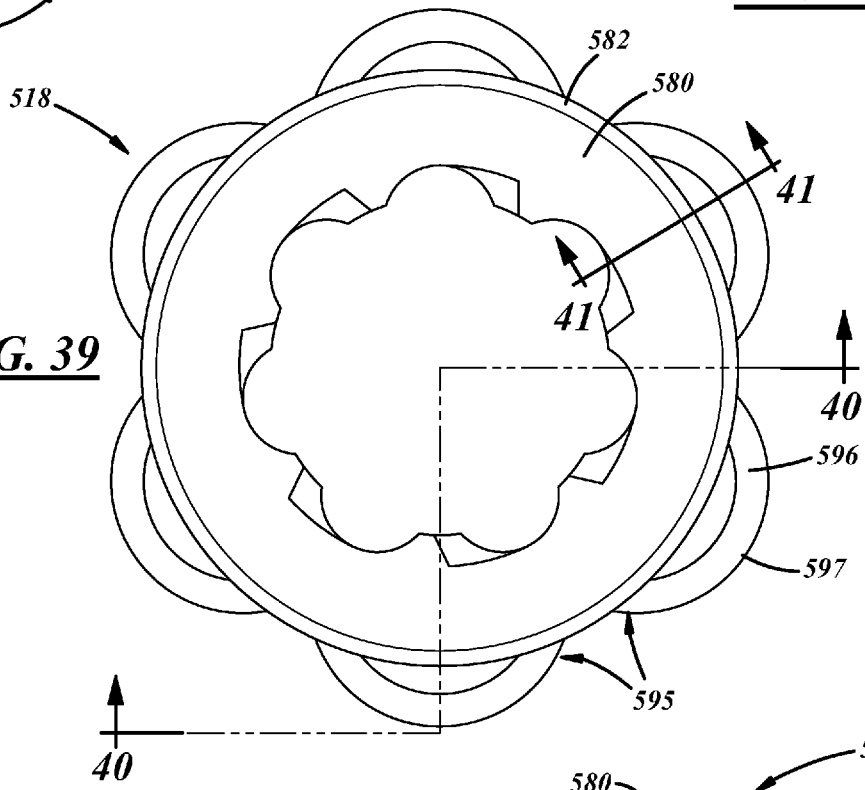
FIG. 39 is a top view of the cover of FIG. 38.
Figure 40:
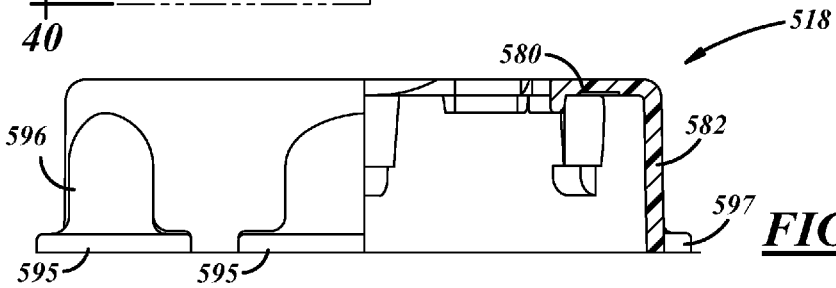
FIG. 40 is a quarter-sectional view of the cover of FIG. 38, taken along line 40-40 of FIG. 38.
Figure 42:
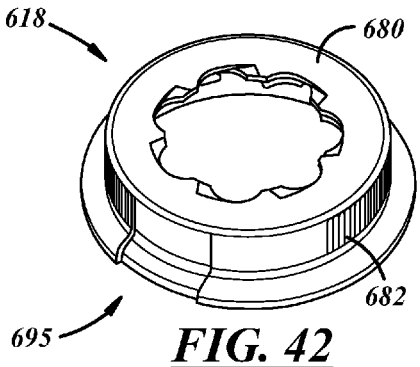
FIG. 42 is a perspective view of a cover in accordance with another exemplary embodiment of the present disclosure, illustrating a fifth exemplary version of a flange to aid consumers in pushing down and turning the cover.

FIGS. 38 through 41 illustrate a cover 518 in accordance with another presently preferred embodiment. The cover 518 includes a base wall 580 and a peripheral skirt 582 depending axially from the base wall 580, and a lobed flange 595 extending from the skirt 582 to aid users in pushing down and turning the cover 518 with their fingers. The flange 595 includes a plurality of lobes that each may include a generally transversely extending wall 596 that extends from the skirt 582, and a generally axially extending rim 597 that extends from the wall 596. As shown in FIG. 41, the wall 596 may be excurvate at an upper portion proximate to where the wall 596 connects to the skirt 582 and may be incurvate at a lower portion proximate to where the wall 596 connects to the rim 597. The user's fingers may engage the cover 518 between the lobes of the flange 595, for example, on the sides of the lobe walls 596, which may provide good circumferential reaction features to aid the user in positively gripping and turning the cover 518.

Figure 45:
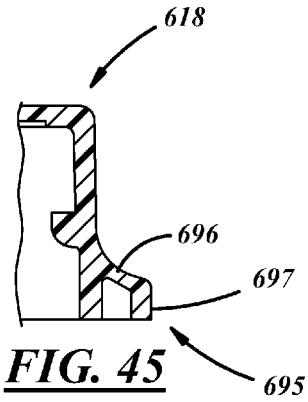
FIG. 45 is a fragmentary sectional view of the cover of FIG. 42, taken along line 45-45 of FIG. 43.
Figure 43:
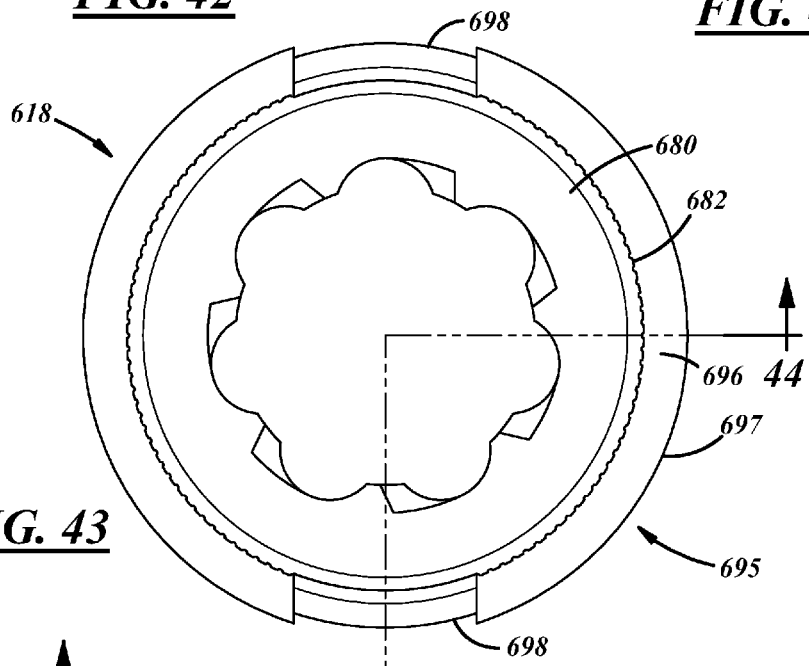
FIG. 43 is a top view of the cover of FIG. 42.
Figure 44:
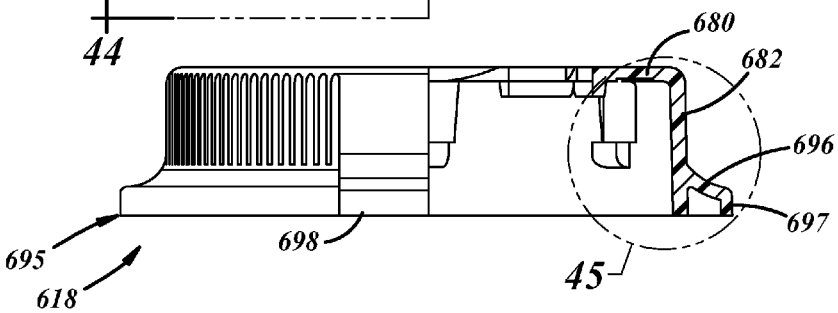
FIG. 44 is a quarter-sectional view of the cover of FIG. 42, taken along line 44-44 of FIG. 43.

FIGS. 42 through 45 illustrate a cover 618 in accordance with another presently preferred embodiment. The cover 618 includes a base wall 680 and a peripheral skirt 682 depending axially from the base wall 680, and an interrupted flange 695 extending from the skirt 682 to aid users in pushing down and turning the cover 618 with their fingers. The flange 695 includes a generally transversely extending wall 696 that extends from the skirt 682, and a generally axially extending rim 697 that extends from the wall 696. As shown in FIG. 45, the wall 696 may be incurvate. Also, as shown in FIG. 43, the flange 695 may include a plurality of interruptions 698 in the wall 696 and in the rim 697. The interruptions 698 may also extend along the skirt 682. The user's fingers may engage the cover 618 at one or more of the interruptions 698, which may provide good circumferential reaction features to aid the user in positively gripping and turning the cover 618.

In the various embodiments of FIGS. 26 through 45, the outer diameters of the flanges 295, 395, 495, 595, 695 as measured by the outer diameters of the rims 297, 397, 497, 597, 697 are larger than the outer diameters of the skirts 282, 382, 482, 582, 682, and the heights of the flanges 295, 395, 495, 595, 695 as measured by the heights of the rims 297, 397, 497, 597, 697 are smaller than the heights of the skirts 282, 382, 482, 582, 682. For example, the outer diameters of the flanges 295, 395, 495, 595, 695 are about 10% to 25% greater in size than the outer diameters of the skirts 282, 382, 482, 582, 682. More particularly, the outer diameters of the flanges 295, 395, 495, 595, 695 are about 14% to 19% greater in size than the outer diameters of the skirts 282, 382, 482, 582, 682. In another example, the heights of the flanges 295, 395, 495, 595, 695 are about 5% to 30% of the heights of the skirts 282, 382, 482, 582, 682. More specifically, the heights of the flanges 295, 395, 495, 595, 695 are about 8% to 25% of the heights of the skirts 282, 382, 482, 582, 682.

There thus has been disclosed child-resistant closures, closure components, and packages using the closures and closure components, that fully satisfy all of the objects and aims previously set forth. The disclosure has been presented in conjunction with several exemplary embodiments, and additional modifications and variations have been discussed. Other modifications and variations readily will suggest themselves to persons of ordinary skill in the art in view of the foregoing discussion. The disclosure is intended to embrace all such modifications and variations as fall within the spirit and broad scope of the appended claims.

The invention claimed is:

1. A child-resistant dispensing package that includes:

a container having an open end, an inner cover non-removably secured to said container over said open end, said inner cover having a deck with a dispensing opening, a peripheral skirt secured to said container in a non-removable manner, a lid hinged to said deck for pivotal movement between a closed position closing said dispensing opening and an open position spaced from said dispensing opening, and an external shoulder with an annular array of under-notches, and an outer cover with a base wall and a peripheral skirt with internal lugs for receipt over said shoulder within said under-notches of said inner cover, at least one internal spring for engaging said inner cover and biasing said outer cover away from said inner cover and releasably registering said internal lugs on said outer cover within said under-notches of said inner cover, a central opening surrounding said lid and defined by lobes and scallops, and cam surfaces on said lobes, wherein downward pressure on said outer cover against said at least one internal spring releases said outer cover for rotation with respect to said inner cover and at least one of said cam surfaces engages said lid and cams said lid from said closed position toward said open position so that said lid can be manually further moved to said open position and medication can be dispensed through said dispensing opening.

2. The package set forth in claim 1 wherein said inner cover also includes a sealing skirt to seal within said open end of said container.

3. The package set forth in claim 1 wherein said peripheral skirt also includes internal stops that cooperate with said projections of said container to render said inner cover effectively non-removable from said container.

4. The package set forth in claim 1 wherein said under-notches include cam features, stop portions, and flat undersides therebetween.

5. The package set forth in claim 1 wherein said lid includes a pintle to sealingly engage said dispensing opening of said deck.

6. The package set forth in claim 1 wherein said lid includes a skirt disposed radially outwardly of said pintle.

7. The package set forth in claim 1 wherein said lid includes a finger tab.

8. The package set forth in claim 7 wherein said finger tab has a cam surface to cooperate with said cam surfaces of said outer cover.

9. The package set forth in claim 1 wherein said lid includes a plurality of lobes corresponding to said scallops of said central opening of said outer cover.

10. The package set forth in claim 9 wherein at least one of said plurality of lobes includes a cam surface to cooperate with said cam surfaces of said outer cover.

11. The package set forth in claim 10 wherein each of at least two opposed lobes of said plurality of lobes includes said cam surface.

12. The package set forth in claim 1 wherein said lid of said inner cover includes dosing indicia and said outer cover includes dosing indicia on said base wall of said outer cover aligned with said scallops of said central opening.

13. The package set forth in claim 12 wherein said indicia includes an arrow to point to said corresponding dosing indicia of said outer cover.

14. The package set forth in claim 1 wherein said outer cover includes a flange extending from said peripheral skirt to aid users in pushing down and turning said outer cover with their fingers, said flange including a generally transversely extending wall extending from said peripheral skirt, a generally axially extending rim extending from said generally transversely extending wall, and at least one of the following features: a plurality of lugs, an incurvate shape of said generally transversely extending wall, scallops in said generally transversely extending wall, a plurality of lobes of said flange, or interruptions in said flange.

15. A child-resistant dispensing closure securable to a container, which includes:

an inner cover securable to said container and including a base having a deck with a dispensing opening, a lid coupled to said base for movement between a closed position closing said dispensing opening and an open position spaced from said dispensing opening, a skirt depending from said deck, a shoulder with an annular array of under-notches, and an outer cover rotatably coupled to said inner cover and including a peripheral skirt with internal lugs for receipt over said shoulder of said inner cover and within said under-notches of said shoulder, and further including a base wall from which said peripheral skirt depends and which includes a central opening at least partially surrounding said lid and at least partially defined by lobes having cam surfaces to cooperate with said lid.

16. The closure set forth in claim 15 wherein said outer cover also includes at least one internal spring to engage said inner cover and bias said outer cover away from said inner cover and thereby releasably lock said internal lugs on said outer cover within said under-notches on said inner cover, wherein downward pressure on said outer cover against said at least one internal spring releases said outer cover for rotation with respect to said inner cover and said cam surfaces engage said lid and cam said lid from said closed position toward said open position so that said lid can be manually further moved to said open position and medication can be dispensed through said dispensing opening.

17. The closure set forth in claim 15 wherein said inner cover also includes a sealing skirt to seal within an open end of said container, and a funnel radially inboard of said sealing skirt to facilitate dispensing of product through said dispensing opening.

18. The closure set forth in claim 15 wherein said lid includes a pintle to sealingly engage said dispensing opening of said deck, a skirt disposed radially outwardly of said pintle, and a finger tab having a cam surface to cooperate with said cam surfaces of said outer cover.

19. The closure set forth in claim 15 wherein said central opening is defined by said lobes and by scallops, and said lid includes a plurality of lobes corresponding to said scallops.

20. The closure set forth in claim 19 wherein at least one of said plurality of lobes includes a cam surface to cooperate with said cam surfaces of said outer cover.

21. The closure set forth in claim 20 wherein each of at least two opposed lobes of said plurality of lobes includes said cam surface.

22. The closure set forth in claim 15 wherein said outer cover includes a flange extending from said peripheral skirt to aid users in pushing down and turning said outer cover with their fingers, said flange including a generally transversely extending wall extending from said peripheral skirt, a generally axially extending rim extending from said generally transversely extending wall, and at least one of the following features: a plurality of lugs, an incurvate shape of said generally transversely extending wall, scallops in said generally transversely extending wall, a plurality of lobes of said flange, or interruptions in said flange.

23. A package including a container and said closure set forth in claim 15.

24. The closure set forth in claim 15 wherein said inner cover includes cam features to cooperate with said internal lugs of said outer cover to assist with registration of said internal lugs into said under-notches and provide tactile feedback to a user that said outer cover is being rotated in a design-intended direction about said inner cover.

25. The closure set forth in claim 24, wherein said cam features permit said outer cover to be unidirectionally rotated with respect to said inner cover.

26. An outer cover of a child-resistant dispensing closure, wherein said outer cover includes:

a peripheral skirt with internal lugs, and a base wall from which said peripheral skirt depends and including a central opening, wherein said central opening is at least partially defined by lobes and by scallops with inclined cam surfaces between said lobes and said scallops, and also including dosing indicia on said base wall corresponding to said scallops to assist a user in complying with a dosage or dosing regimen.

27. A cover of a child-resistant dispensing closure, which cover includes a base including:

a deck having a dispensing opening therethrough;

an inner skirt extending from an inner surface of the deck;

an outer peripheral skirt disposed radially outwardly of the inner skirt and including a plurality of lugs extending from an inner surface of said outer peripheral skirt and a plurality of stops extending from an inner surface of said outer peripheral skirt; and an external shoulder between said deck and said outer peripheral skirt and said external shoulder including an annular array of under-notches.

28. The cover set forth in claim 27 wherein said base also includes cam features disposed on at least one of said deck or said outer peripheral skirt.

29. The cover of claim 27 also including a funnel radially inboard of said inner skirt to facilitate dispensing of product through said dispensing opening.

30. The cover set forth in claim 27, wherein said plurality of lugs extend radially inwardly from said outer peripheral skirt and are circumferentially spaced, and said plurality of stops extend radially inwardly from said outer peripheral skirt and are circumferentially interspersed between said circumferentially spaced lugs to fit between the locking projections of the container.

31. A push-and-turn cover for a container, which includes: an inner cover with a lid; and an outer cover including: a base wall; a peripheral skirt depending from said base wall; and a flange extending from and larger in outer diameter than said peripheral skirt to aid users in pushing and turning said outer cover with their fingers, said flange including a generally transversely extending wall extending from said peripheral skirt to provide an axial reaction feature for a user's fingers, a generally axially extending rim extending from said generally transversely extending wall, and including a plurality of lugs extending from a top surface of the flange and having wavy surfaces to provide circumferential reaction features for the user's fingers.

32. The cover of claim 31 wherein the outer diameter of said flange is about 10% to 25% greater in size than the outer diameter of said peripheral skirt.

33. The cover of claim 32 wherein the outer diameter of said flange is about 14% to 19% greater in size than the outer diameter of said peripheral skirt.

34. The cover of claim 31 wherein the height of said flange is about 5% to 30% of the height of said peripheral skirt.

35. The cover of claim 34 wherein the height of said flange is about 8% to 25% of the height of said peripheral skirt.

36. The cover of claim 31 wherein the outer diameter of said flange is about 10% to 25% greater in size than the outer diameter of said peripheral skirt, and wherein the height of said flange is about 5% to 30% of the height of said peripheral skirt.

37. The cover of claim 36 wherein the outer diameter of said flange is about 14% to 19% greater in size than the outer diameter of said peripheral skirt, and wherein the height of said flange is about 8% to 25% of the height of said peripheral skirt.

38. A child-resistant dispensing package, which includes:

a container having an open end; and a closure non-removably secured to said container, and including:

an inner dispensing cover non-removably secured to said open end of said container and including a flip-top lid; and an outer cover non-removably secured to said dispensing cover and cooperable with said dispensing cover to render said closure child-resistant wherein said outer cover includes a base wall with an opening at least partially surrounding said lid of said inner dispensing cover and at least partially defined by lobes having cam surfaces co-operable with said lid to cam said lid from a closed position toward an open position such that said flip-top lid is openable by pushing and turning said outer cover.

39. The package set forth in claim 38 wherein said outer cover is indexable with respect to said dispensing cover.

40. A child-resistant dispensing closure includes an outer cover including a base wall and a peripheral skirt extending from said base wall and including a plurality of internal lugs; and an inner cover including a base having:

a deck, an outer peripheral skirt including a plurality of lugs and stops, an external shoulder between said deck and said skirt and having an annular array of under-notches, and a plurality of cam features that cooperate with said internal lugs of said outer cover to permit said outer cover to be unidirectionally rotated with respect to said cover, to assist with registration of said internal lugs into said under-notches of said inner cover, and to provide tactile feedback to a user that said outer cover is being rotated in a design-intended direction about said cover.

41. A package that includes, a container; and a child-resistant dispensing closure coupled to said container and including:

an inner cover securable to said container and including:

a base having a deck with a dispensing opening, a shoulder with an annular array of under-notches, and a flip-top lid coupled to said base for movement between a closed position closing said dispensing opening and an open position spaced from said dispensing opening, and an outer cover securable and rotatable with respect to said inner cover and including:

a peripheral skirt with internal lugs for receipt over said inner cover and within under-notches of said inner cover, and a base wall from which said peripheral skirt depends and including a central opening at least partially defined by lobes having cam surfaces.

42. The package set forth in claim 41 wherein said outer cover also includes at least one internal spring to engage said inner cover and bias said outer cover away from said inner cover and thereby releasably lock said internal lugs on said outer cover within said under-notches on said inner cover, wherein downward pressure on said outer cover against said at least one internal spring releases said outer cover for rotation with respect to said inner cover and said cam surfaces engage said lid and cam said lid from said closed position toward said open position so that said lid can be manually further moved to said open position and medication can be dispensed through said dispensing opening.

* * * * *